US007434904B2

(12) United States Patent
Tanaka et al.

(10) Patent No.: US 7,434,904 B2
(45) Date of Patent: Oct. 14, 2008

(54) IMAGE RECORDING APPARATUS

(75) Inventors: Arichika Tanaka, Kanagawa (JP); Susumu Kibayashi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 168 days.

(21) Appl. No.: 11/580,469

(22) Filed: Oct. 13, 2006

(65) Prior Publication Data

US 2007/0263021 A1 Nov. 15, 2007

(30) Foreign Application Priority Data

May 9, 2006 (JP) ..... 2006-130711

(51) Int. Cl.
*B41J 29/393* (2006.01)

(52) U.S. Cl. ..... 347/14; 347/19

(58) Field of Classification Search ..... 347/5, 347/9, 12, 14, 19, 104, 105; 399/45, 66, 399/68, 388

See application file for complete search history.

(56) References Cited

U.S. PATENT DOCUMENTS

2002/0061198 A1* 5/2002 Sameshima et al. ..... 399/68

2004/0170457 A1* 9/2004 Kamimura et al. ..... 399/388

FOREIGN PATENT DOCUMENTS

JP 2-80269 3/1990

* cited by examiner

*Primary Examiner*—Lamson D. Nguyen
(74) *Attorney, Agent, or Firm*—Fildes & Outland, P.C.

(57) ABSTRACT

In an image recording apparatus disclosed by this invention, a recording medium is conveyed to a recording head having recording unit groups each in which a plurality of the recording units for recording an image are arranged at a predetermined interval linearly at a predetermined angle with respect to a predetermined direction. When the recording medium is conveyed at a predetermined average velocity, an image recording start timing of each recording column is controlled with the recording units contained in a direction intersecting with the predetermined direction of the recording head as a recording column so as to form a linear dot string having an angle different from the predetermined angle in the recording medium by means of the respective recording units of the recording head.

19 Claims, 21 Drawing Sheets

FIG.5A
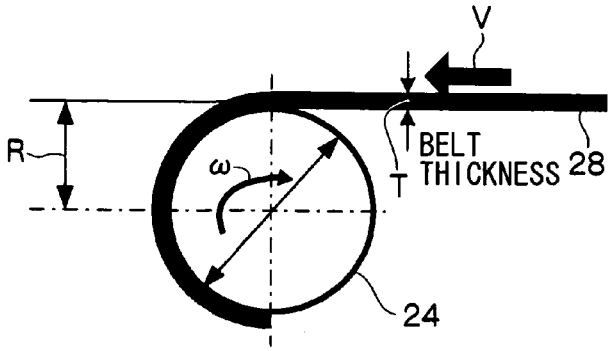
FIG.5B
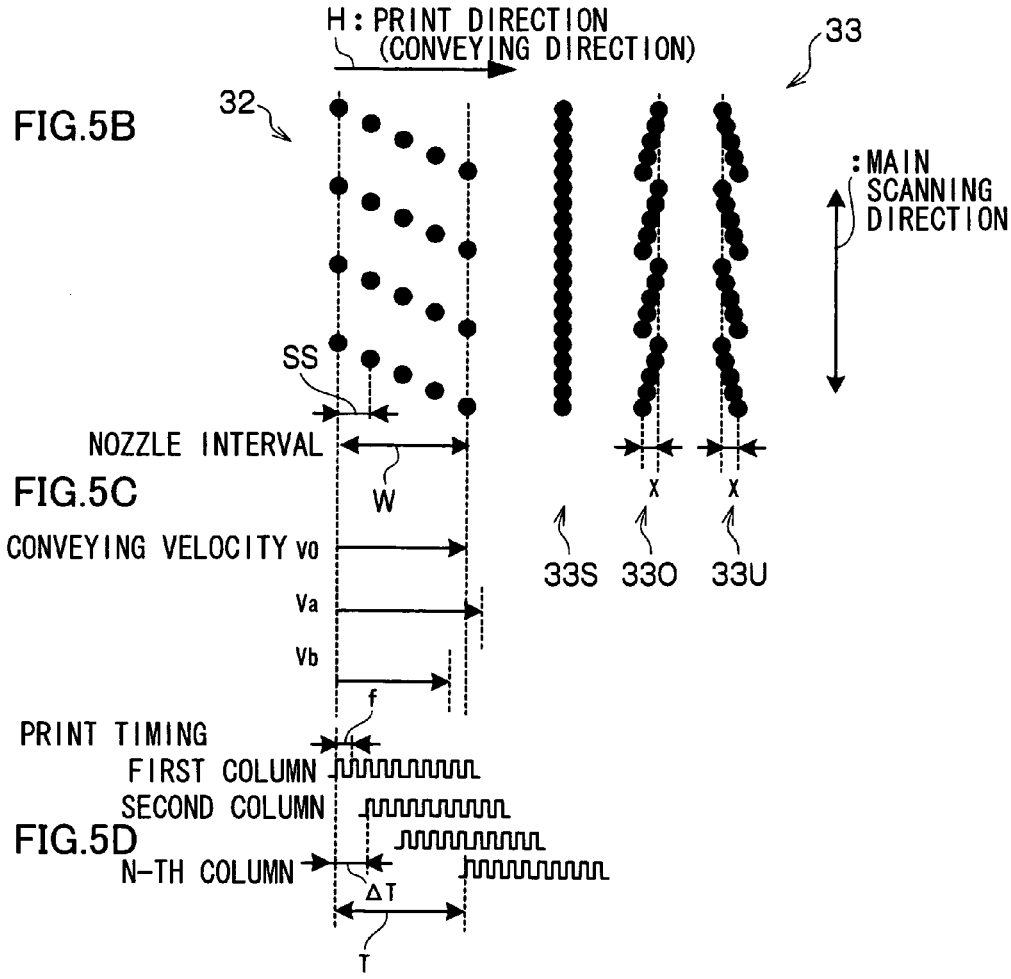
FIG.5C
FIG.5D

IMAGE RECORDING APPARATUS

BACKGROUND OF THE INVENTION

1. Technical Field

The present invention relates to an image recording apparatus and more particularly to an image recording apparatus including a recording head such as a droplet ejecting head each provided with plural nozzles for ejecting liquid droplets for recording an image.

2. Related Art

Well known conventionally are ink jet recording apparatuses (so-called ink jet printers) having an ink jet recording head which cause changes in the volume (expansion/contraction) of pressure generating chambers filled with ink, using an actuator constituted of piezoelectric device and the like, so as to eject ink droplets from the front end of a nozzle communicating with the pressure generating chamber.

Recently, there is an increasing tendency to make ink jet recording apparatuses smaller and increase printing speeds. Thus, ink jet recording heads are being used which are capable of forming an image over a wide area in as short a time as possible by extending the length thereof, increasing the number of nozzles per ink jet recording head and arranging the nozzles in line.

Such an ink jet recording apparatuses adopt roll conveying methods, in which plural conveying rolls are disposed along a conveying direction (conveying path) and driven to transport a recording medium, and belt conveying methods, in which a conveying belt is wound around drive rolls at both ends and moved by driving the drive rolls in order to transport a recording medium or the like.

In the roll conveying methods, the conveying speed of the recording medium changes due to changes in rotation speed of each conveying roll. In the belt conveying method, the conveying speed of the recording medium changes because of unevenness of thickness of the conveying belt or the accuracy of components such as the circularity of the drive roll or the like. As a consequence, a recording medium conveyed at a changed conveying speed passes the recording head at the changed speed so that an image formed with droplets ejected from the recording head at a predetermined timing is deformed. For example, part or whole of the image is expanded or contracted in the conveying direction or unevenness in density occurs. When a color image is produced by overlapping plural colors, due to misalignment between respective images or unevenness of density within a single color image, smudged colors occur leading to reduction of the quality of color images.

To solve this problem, is known a technology for adjusting printing timing, by detecting a belt surface velocity by providing a sensor in the vicinity of each print head for recording a color image on the recording medium or by detecting the velocity of the belt surface with the interval between respective print heads set to a distance equal to the peripheral length of the drive roll.

There has been also a technology which aims at improving recording velocity by using a recording head in which nozzles are arranged two-dimensionally. With two-dimensional arrangement of the nozzles, if the actual conveying velocity of the recording medium does not coincide with the prescribed conveying velocity determined with respect to a standard image recording timing specified as the interval between recorded dots by adjacent nozzles in the conveying direction, that is, if the distance traveled at the conveying velocity between the image record timings of the adjoining nozzles does not coincide with the interval of recorded dots by the distance between the nozzles (nozzle pitch), disjointing of the lines in a main scanning direction is generated (unevenness in print density). Consequently, bad quality characters and line drawing occurs.

SUMMARY

Accordingly, the present invention has been made in view of the above circumstances and provides an image recording apparatus capable of forming an image with low deterioration of the image quality even if plural recording units for recording an image are disposed two-dimensionally.

According to an aspect of the invention, an image recording apparatus is provided which includes: a recording head having recording unit groups each recording unity group including plural recording units for recording an image are linearly arranged at a predetermined interval and at a predetermined angle with respect to a predetermined direction; a conveying unit for conveying a recording medium to the recording head in the predetermined direction; and a control unit for controlling an image recording start timing of each recording column, with recording units of the plural recording units contained in a direction intersecting the predetermined direction of the recording head being recording columns, so as to form a linear dot string on the recording medium having an angle different from the predetermined angle by means of the respective recording units of the recording head when the recording medium is conveyed at a predetermined average velocity.

Other aspects, features and advantages of the invention will become apparent from the following description taken in conjunction with the accompanying drawings.

BRIEF DESCRIPTION OF THE DRAWINGS

Exemplary embodiments of the present invention will be described in detail based on the following figures, in which:

FIGS. 5A-5D are explanatory diagrams for explaining dot formation conditions depending on changes in conveying speed in the ink jet recording apparatus according to the embodiment of the invention, wherein FIG. 5A is a schematic diagram of the periphery of the drive roll; FIG. 5B is an image diagram of arrangement of ink jet recording heads and dot formation conditions; FIG. 5C is a diagram of relationship between conveying speeds; and FIG. 5D is a print timing chart;

DETAILED DESCRIPTION

Hereinbelow, the exemplary embodiments of the invention will be described in detail with reference to the accompanying drawings. Description will now be made to a case where the invention is applied to an ink jet recording apparatus for recording an image by ejecting ink droplets.

In a first exemplary embodiment of the invention, the invention is applied to a case of correcting print timing based on an average speed for conveying paper P in order to suppress generation of disjointing in a line (unevenness in print) in a main scanning direction in an ink jet recording apparatus having a recording head in which nozzles for ejecting ink droplets are arranged two-dimensionally.

Figure 1:
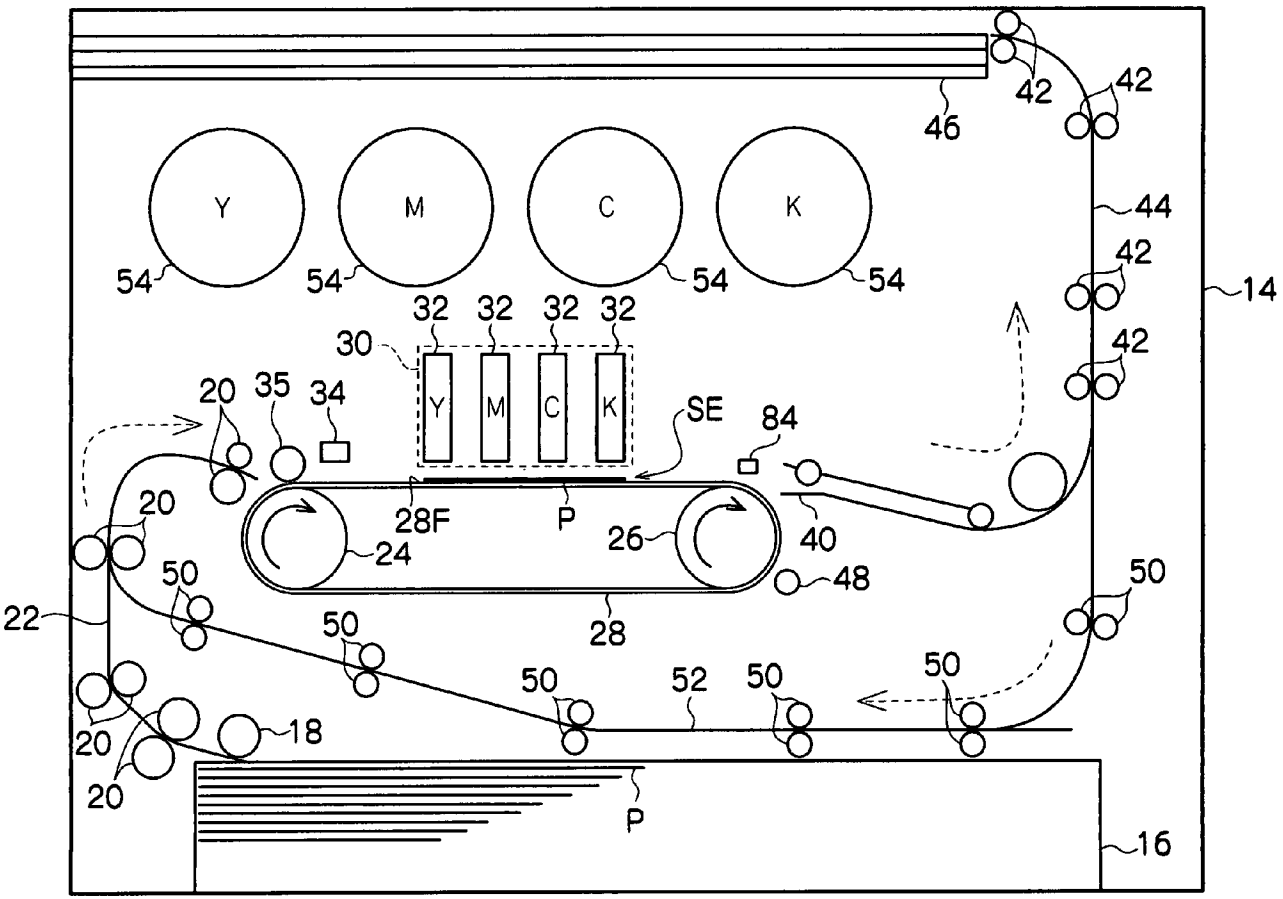
FIG. 1 is a front sectional view showing in an image recording condition the structure of an ink jet recording apparatus according to an exemplary embodiment of the invention.

FIG. 1 shows an ink jet recording apparatus 12 of this exemplary embodiment. A paper feeding tray 16 is provided at the bottom of a casing 14 of the ink jet recording apparatus 12 and papers P stacked in the paper feeding tray 16 can be picked up one by one by a pickup roll 18. The picked up paper P is conveyed by plural conveying roller pairs 20 which constitute a predetermined conveying path 22. Hereinafter, just "conveying direction" refers to a conveying direction of the paper P as a recording medium and "upstream" and "downstream" refer to upstream and downstream in the conveying direction respectively.

An endless conveying belt 28 stretched between a drive roll 24 and a driven roll 26 is disposed as a conveying means over the paper feeding tray 16. A recording head array 30 is disposed above the conveying belt 28 and opposes a flat portion 28F of the conveying belt 28. This opposing area is an ink jet area SE at which ink droplet is ejected from the recording head array 30. The paper P conveyed by the conveying path 22 is held by the conveying belt 28 and reaches this ink jet area SE in a condition opposing the recording head array 30, and ink droplets are ejected according to image information from the recording head array 30.

By conveying the paper P with the conveying belt 28 and passing the paper P through the ink jet area SE, an image is recorded on the paper P. It is also possible to record the image by "multi-pass" in which the paper P is passed through the ink jet area SE plural times by circulating the paper P with the conveying belt 28.

The means for conveying the paper P as a recording medium to the recording head array 30 is not restricted to the conveying belt 28. For example, the paper P may be sucked and held on the outer periphery of a a cylinder or conveying rollers formed into a column and rotated therewith. However, if the conveying belt 28 is used as described in this embodiment, a flat portion 28F is formed and then, the recording head array 30 can be disposed corresponding to the flat portion 28F, which is preferable.

In the recording head array 30 of this embodiment, the effective recording area is an elongate area having a width larger than the width of the paper P (length in a direction perpendicular to the conveying direction) and four ink jet recording heads 32 corresponding to four colors, yellow (Y), magenta (M), cyan (C) and black (K) are arranged along the conveying direction so as to be able to record a full-color image. Meanwhile, in each ink jet recording head 32, a method for ejecting ink droplet is not restricted to any particular method and any well known method such as thermal type, piezoelectric type may be adopted.

Each ink jet recording head 32 is controlled by a recording head controller 78 (see FIG. 4) as a control means which will be described later. The recording head controller 78 determines the ink jet nozzle for use and the ejection timing of ink droplets corresponding to the image information and sends a drive signal to the ink jet recording head 32. Although the recording head array 30 may be set so as to be immobile in a direction perpendicular to the conveying direction, depending on requirements if it is constructed to be movable an image having a higher resolution can be recorded by recording the image by multi-pass processing or any faults in the ink jet recording head 32 can be prevented from being reflected in the recording result.

Although not shown, a maintenance unit which moves into a gap between the recording head array 30 and the conveying belt 28 to carry out predetermined maintenance operations (vacuuming, dummy jetting, wiping, capping and the like) is disposed in the vicinity (at least one side of upstream side and downstream side in the conveying direction) of the recording head array 30.

On the other hand, a line sensor 84 constituted of CCD is disposed in the downstream of the recording head array 30 so that an image recorded on the paper P by the recording head array 30 can be captured. According to this embodiment, the line sensor 84 is formed in a rectangular shape having an effective image pickup area larger than the width of the paper P (length in a direction perpendicular to the conveying direction). The line sensor 84 applicable to this embodiment has a resolution of about four times the resolution for recording an image of the ink jet recording head 32 (about twice the nozzle resolution). Although a CCD line sensor is used as the line sensor 84, this embodiment is not restricted to this example and other solid-state image pickup device such as CMOS image sensor may be used. The line sensor 84 is controlled by a sensor controller 86 which will be described later (see FIG. 7).

A charging roll 35, to which a power supply (not shown) is connected, is disposed at the upstream of the recording head array 30. The charging roll 35 is driven by the drive roll 24 in a condition in which the conveying belt 28 and the paper P are nipped therebetween and is movable from a pressing position for pressing the paper P against the conveying belt 28 to a retracted position away from the conveying belt 28. At the pressing position, the paper P is suctioned by the conveying belt 28 by charging the paper P.

A separation plate 40 formed of aluminum plate is disposed at the downstream of the line sensor 84 of the recording head array 30 so as to separate the paper P from the conveying belt 28. The separated paper P is conveyed by plural discharge roller pairs 42 which constitute a discharge path 44 in the downstream of the separation plate 40 and discharged to a discharge tray 46 provided on the top portion of the casing 14.

A cleaning roll 48 capable of nipping the conveying belt 28 with the drive roll 24 is disposed below the separation plate 40 so as to clean the surface of the conveying belt 28.

An inverting path 52 which is constituted by plural inverting roller pairs 50 is provided between the paper feeding tray 16 and the conveying belt 28, so that recording of images on both sides of the paper P can be carried out easily by conveying the paper P having an image recorded on one side by means of the conveying belt 28 in an inverted state.

Ink tanks 54 for storing inks of four colors are provided between the conveying belt 28 and the discharge tray 46. Ink in the ink tanks 54 is supplied to the recording head array 30 by ink supply pipes (not shown). For ink, well known various inks such as water-based inks, oil-based inks, and solvent inks may be used.

Next, the structure of the ink jet recording head 32 of this embodiment will be described.

Figure 2:
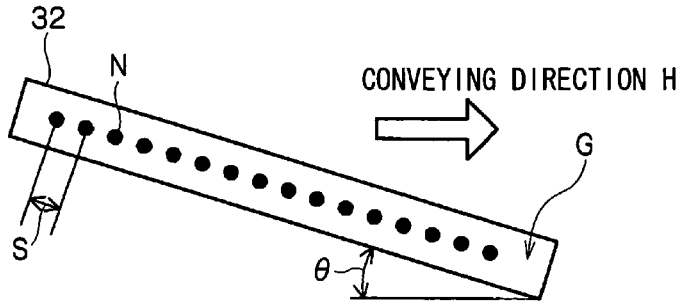
FIG. 2 is a bottom view showing a group of nozzles of the ink jet recording head according to the exemplary embodiment of the invention.

As shown in FIG. 2, each of the ink jet recording heads 32 of respective colors is constituted by a nozzle group G in which plural nozzles N which eject ink droplets for recording an image are disposed at an equal pitch S. The ink jet recording head 32 is disposed at an inclination angle θ with respect to the conveying direction. The pitch S, the inclination angle θ and the quantity of the nozzles are only for illustration purposes and the values are not limited to those indicated in the drawing.

Figure 3:
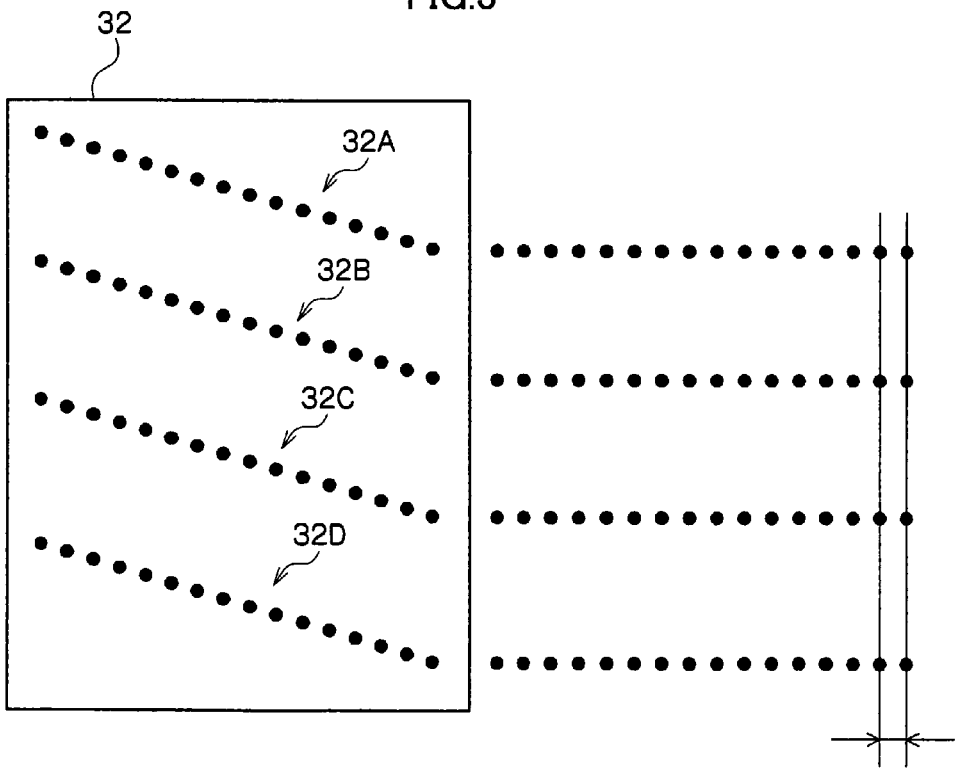
FIG. 3 is a bottom view showing the structure of the ink jet recording head constituted by plural nozzle groups according to the exemplary embodiment of the invention.

According to this embodiment, the ink jet recording head 32 having nozzles N arranged two-dimensionally as shown in FIG. 3 can be attached to adjust the image recording timing as described in detail below. As shown in FIG. 3, in this ink jet recording head 32, plurality (four in FIG. 3) of the nozzle groups G arranged in a line as shown in FIG. 2 are disposed in a direction perpendicular to the direction of arrangement of the nozzles N. That is, the plural head units 32A, 32B, 32C, 32D each having the nozzle group G in which plural of the nozzles N are arranged at an equal pitch S in line are disposed such that adjoining head units do not overlap each other in the conveying direction H of the nozzle group G Although the head units 32A-32D are of the same specification, the ink jet recording heads 32 are sometimes designated as head units 32A-32D for convenience when each head unit is explained individually in the following description.

Next, the structure of the electric major portions of the ink jet recording apparatus 12 of this embodiment will be described with reference to FIG. 4.

Figure 4:
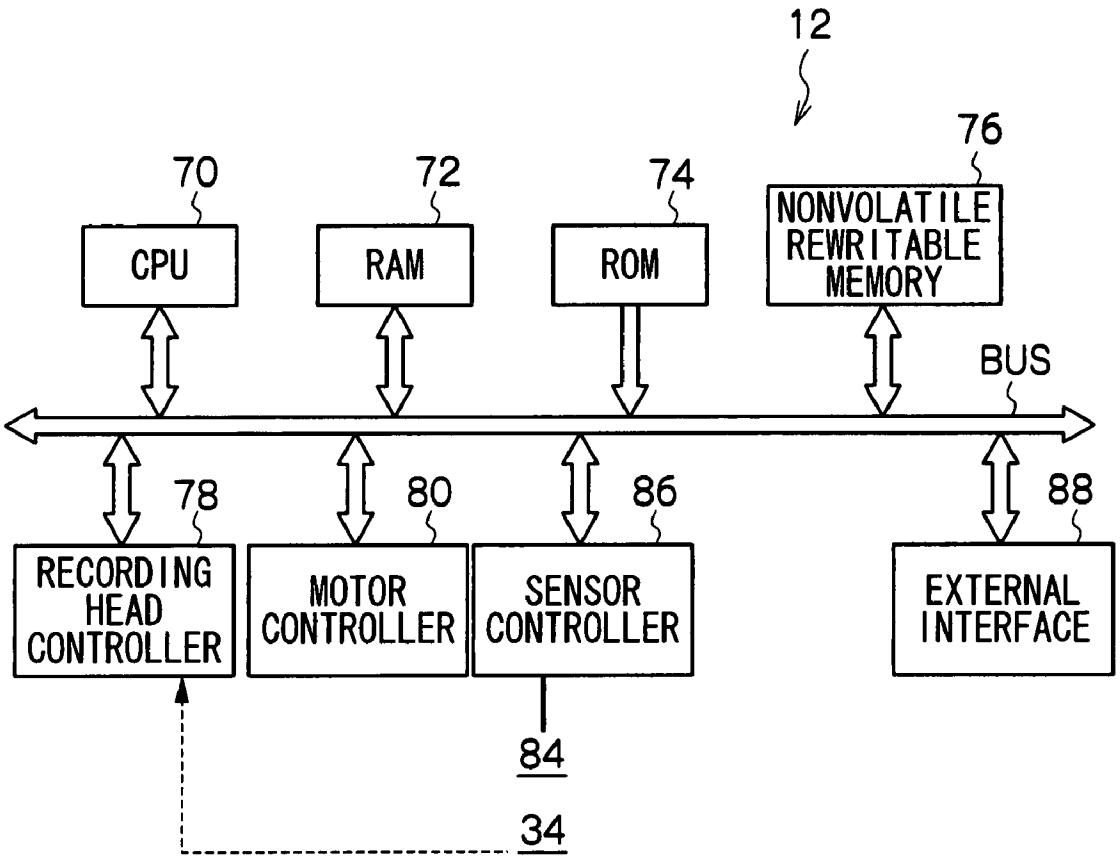
FIG. 4 is a block diagram showing the structure of major electrical sections of the ink jet recording apparatus according to the exemplary embodiment of the invention.

As shown in FIG. 4, the ink jet recording apparatus 12 of this embodiment includes a CPU (central processing unit) 70 which controls the operation of the entire apparatus, a RAM 72 for use as a work area at the time of executing various programs, a ROM 74 which stores various programs, parameter information and the like, and a nonvolatile, rewritable memory 76. The ink jet recording apparatus 12 further includes: a recording head controller 78, for controlling the operation of the ink jet recording head 32, the pickup roll 18, and the conveying roller pairs 20; a motor controller 80 for controlling the operation of plural motors (not shown) for driving respective components including the drive roller 24; a sensor controller 86 for controlling the operation of the line sensor 84; and an external interface 88 for connecting an external unit such as personal computer electrically and mechanically. A paper detecting sensor 34 for detecting the position of a front edge of the paper P is connected to the sensor controller 86. This paper detecting sensor 34 can be connected directly to the recording head controller 78.

The CPU 70, RAM 72, ROM 74, memory 76, recording head controller 78, motor controller 80, sensor controller 86 and external interface 88 are connected to each other electrically through a system bus BUS. Therefore, the CPU 70 can execute access to the RAM 72, ROM 74 and memory 76, control of the operation of the recording head controller 78, motor controller 80 and sensor controller 86, acquisition of output signal from a sensor such as the line sensor 84 and exchange of various information with external units through the external interface 88. Although the ink jet recording apparatus 12 of this embodiment includes plural electric components such as a power supply for applying a voltage to a charging roll as well as the above-described composition, detailed description thereof is omitted because they are well known or common matters.

In the ink jet recording apparatus 12 of this embodiment having the above-described structure, the paper P picked up from the paper feeding tray 16 is conveyed and reaches the conveying belt 28. Then, the paper P is pressed against the conveying belt 28 by the charging roll 35 and suctioned firmly and held by the conveying belt 28 with applied voltage from the charging roll. With this condition, the paper P passes the ink jet area SE by circulation of the conveying belt and ink droplets are ejected from the recording head array 30 so as to record an image on the paper P. Then, the paper P in which an image is recorded is separated from the conveying belt 28 by the separation plate 40 and conveyed by the discharge roller pair 42 and discharged to the discharge tray 46.

The generation and suppression of unevenness in print density resulting in poor quality characters and lines being drawing in the ink jet recording apparatus having a recording head with two-dimensionally arranged nozzles of this embodiment will be described with reference to FIGS. 5A-5D.

In the ink jet recording apparatus 12 of this embodiment as shown in FIG. 5A, the conveying belt 28 wound around the drive roll 24 is rotated in a predetermined direction at an angular velocity of ω and moved at a conveying velocity V in a conveying direction H. This conveying velocity V is determined by multiplying the radius R (=(D+t)/2), which is the central value of the diameter D of the conveying roll 24 and the thickness t of the conveying belt 28, by the angular velocity ω (V=R×ω). When the nozzle interval of adjacent nozzles N in the conveying direction H in the ink jet recording head 32 having two-dimensionally arranged nozzles is SS, the interval W between nozzles located at extreme ends in the conveying direction H of each head unit is determined by nozzle number m (W=m×SS)[this should be W=(m−1)×SS]. Each nozzle N in the head units 32A-32D is driven at the basic print timing frequency. At this time, ejecting of ink droplets from the nozzles N from each of the head units 32A-32D is started at a print timing depending on a predetermined time difference (dT) corresponding to the nozzle interval SS. Thus, a time T required until an ink droplet is ejected from all the nozzles N of each head unit is a time difference dT multiplied by the quantity of nozzles (m) (T=m·dT) [this should be m−1].

If the conveying distance over which the conveying belt 28 (paper P) is conveyed in the time interval of T at a conveying velocity V is the same as the interval W between nozzles at extreme ends, then dots can be formed linearly in the main scanning direction as indicated as dot formation condition 33S in FIG. 5B. If the conveying velocity V for obtaining this dot formation condition 33S is conveying velocity V0, then each head unit can form dots in a line at a conveying velocity Va, shown in FIG. 5C, that is higher than the conveying velocity V0 as indicated in dot formation condition 33O of FIG. 5B. However, the dots are formed linearly but angled back in the conveying direction H, having a distance x between nozzles at extreme ends, so that the dots between the head units are not formed linearly. Likewise, at a conveying velocity Vb that is lower than the conveying velocity V0, dots are formed linearly but angled with respect to the conveying direction H as indicated in dot formation condition 33U, so that the dots between the head units are not formed linearly. As one of causes of such conveying velocity changes, a possible cause is when the outside diameter of the drive roll changes due to dimensional differences of components upon replacement.

According to this embodiment, unevenness in print density is prevented by changing the print start timing of each nozzle column depending on an average value (average velocity) of the conveying velocity of the paper P and synchronizing the print start timing with the conveying velocity of the paper P. In detail, the time difference dT (print start timing) is adjusted according to the relationship between time difference dT, nozzle interval SS and conveying velocity V so as to obtain an expression (V=SS/dT).

Figure 9:
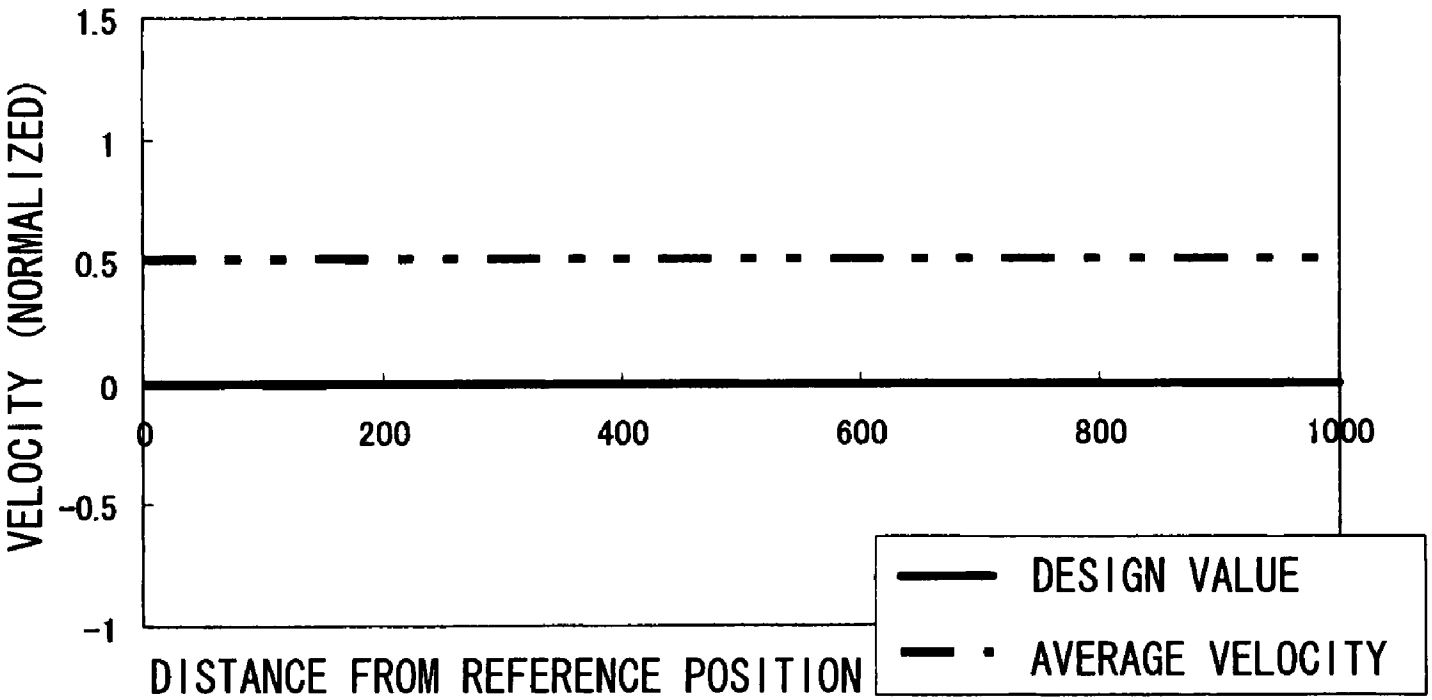
FIG. 9 is a diagram showing the relationship between an ideal value and average speed of conveying in the ink jet recording apparatus according to the first embodiment of the invention.

As shown in FIG. 9 if the conveying velocity varies relative to the conveying velocity determined from a design value (indicated with solid line in FIG. 9) of each component of the ink jet recording apparatus 12 (more specifically, derived from the diameter of the drive roll 24, thickness of the conveying belt 28 and the like) (for example, due to an increase in the diameter of the drive roll 24), the average value (indicated with two dots and dash line as an average velocity in FIG. 9) of the conveying velocity increases. In this case, even at a print timing which instructs formation of linear dots, the dots are formed disjointedly (dot formation condition 33O in FIG. 5B). Unevenness in print density can be eliminated by adjusting the print start timing according to the difference between the conveying velocity predetermined according to the design value and the average velocity.

Next, the detail of the electric recording head controller 78 in the ink jet recording apparatus 12 of this embodiment which eliminates unevenness in print density by changing the conveying velocity will be described with reference to the drawings.

Figure 6:
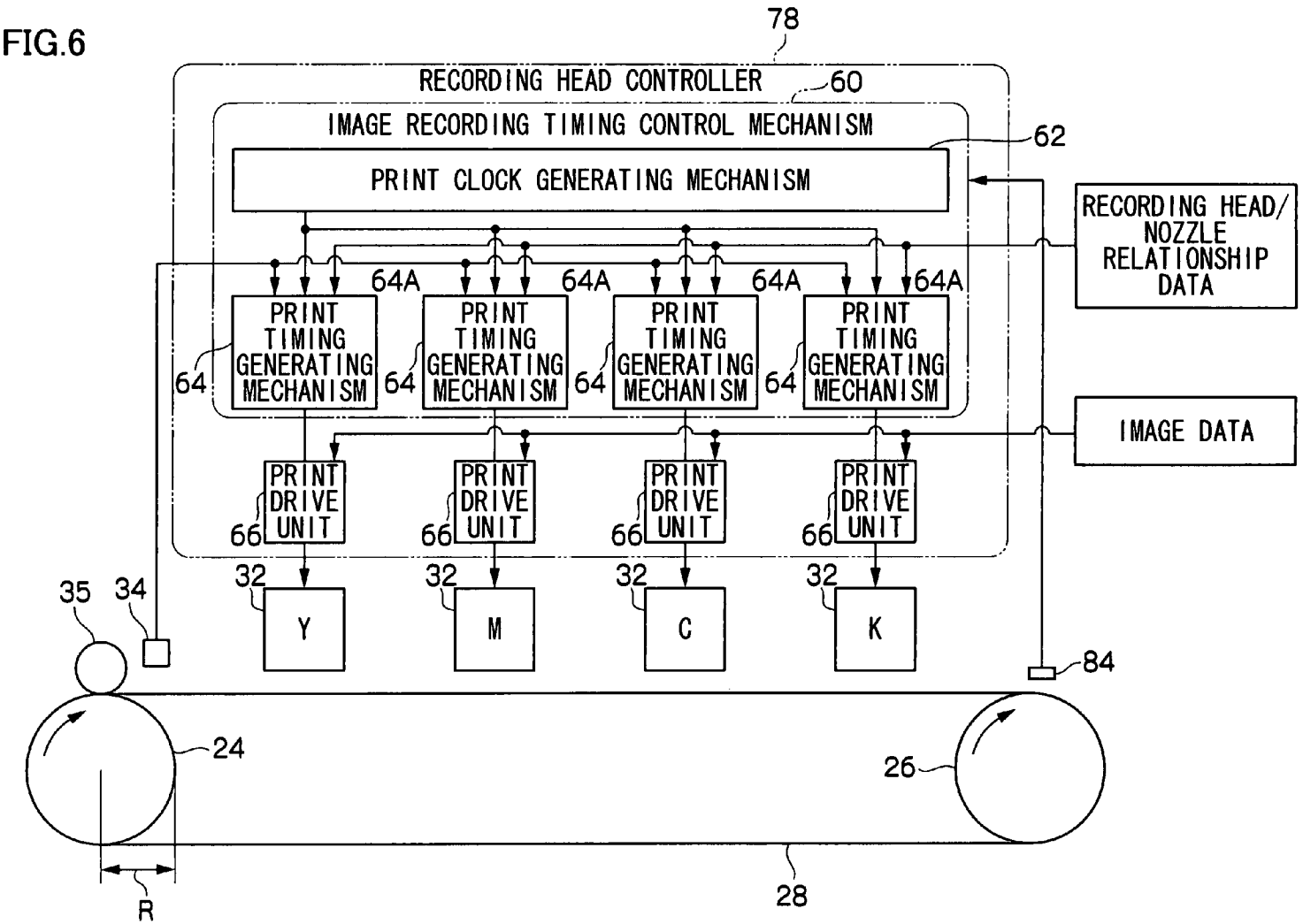
FIG. 6 is a block diagram showing the structure of major portions surrounding an electric recording head controller of the ink jet recording apparatus according to a first embodiment of the invention.

As shown in FIG. 6, the recording head controller 78 includes an image recording timing control mechanism 60 and print drive unit 66, and the output side of the print drive unit 66 is connected to the ink jet recording heads 32 of corresponding colors. The image recording timing control mechanism 60 controls the image recording timing (print timing) of the ink jet recording head 32 to eliminate velocity changes based on the average velocity determined for the paper P in order to correct for unevenness in print density which occurs due to changes in the conveying velocity of the paper P. The print drive unit 66 generates a drive signal by synthesizing the regulated image recording timing signal and image data, and sends this drive signal to the ink jet recording head 32.

The image recording timing control mechanism 60 includes a print clock generating mechanism 62 and print timing generating mechanisms 64 corresponding to each of the colors. The image recording timing control mechanism 60 is connected to the line sensor 84 and a signal from the line sensor 84 is inputted thereto.

The print clock generating mechanism 62 generates a print clock signal from a reference clock and outputs it to the print timing generating mechanisms 64. The paper detecting sensor 34 is connected to each of the print timing generating mechanisms 64 and a paper detection signal of the paper P is inputted. Nozzle relationship data such as nozzle position relationships and distance of the ink jet recording head 32 is inputted to the print timing generating mechanisms 64. These print timing generating mechanisms 64 generate a print timing signal based on the print clock signal and reference clock signal from the print clock generating mechanism 62, nozzle relationship data and paper detecting signal from the paper detecting sensor 34 (paper edge timing based on the paper detecting signal, see the leading edge of the paper detecting signal in FIG. 8) and outputs this print timing signal to the print drive unit 66.

Figure 7:
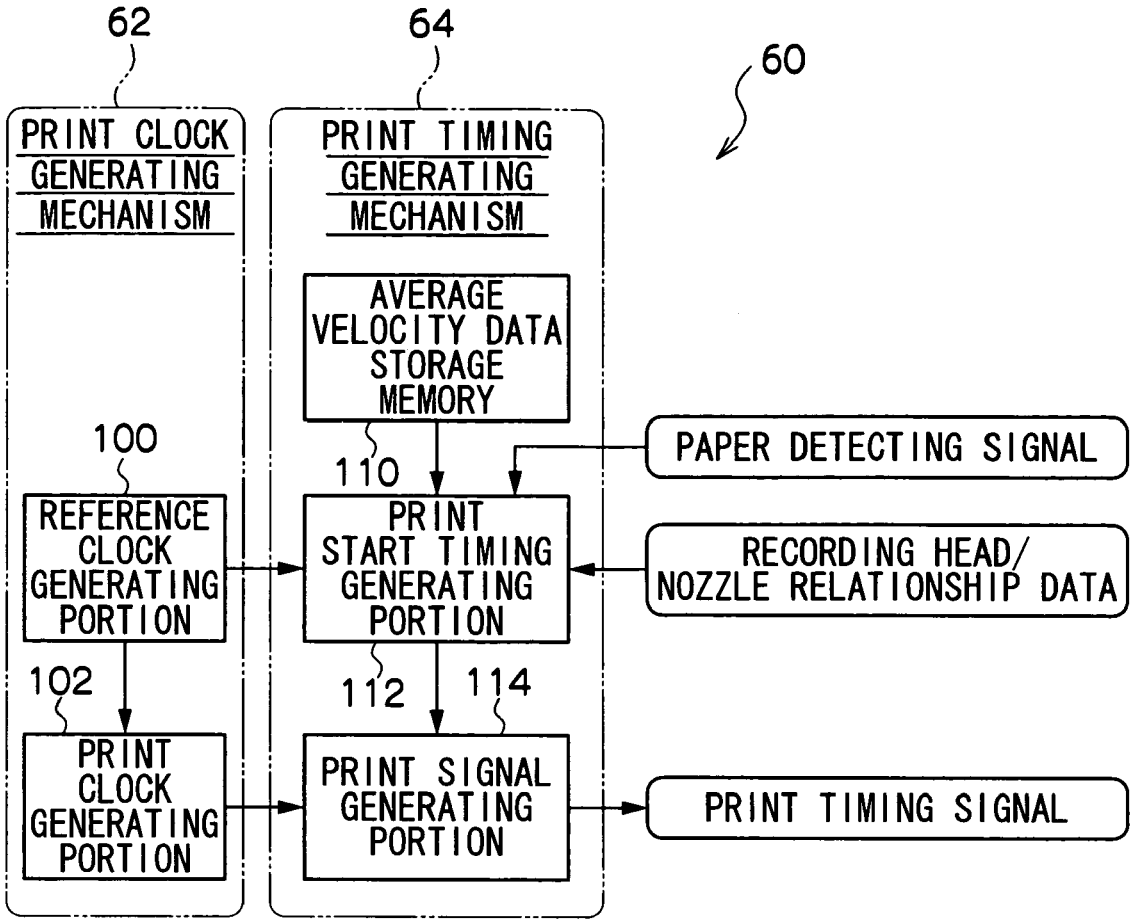
FIG. 7 is a block diagram showing the schematic structure of the image recording timing control mechanism according to the first embodiment of the invention.

As shown in FIG. 7, the print clock generating mechanism 62 includes a reference clock generating portion 100 and a print clock generating portion 102. The reference clock generating portion 100 generates a clock serving as a standard for generating a variety of timing signals such as reference print frequency F (for example, 18 kHz) and the like and includes, for example, an ASIC, FPGA, oscillator and the like. This reference clock generating portion 100 is configured to output, for example, a signal of reference print frequency F to the print clock generating portion 102 and the print timing generating mechanism 64 as a reference clock signal. The print clock generating portion 102 generates a print clock for driving the ink jet recording head 32 from the basic clock signal from the reference clock generating portion 100 and outputs a generated print clock signal to the print timing generating mechanism 64.

The print timing generating mechanism 64 includes an average velocity data storage memory 110, a print start timing generating portion 112 and a print signal generating portion 114. The average velocity data storage memory 110 is a memory which stores data corresponding to the belt average velocity (hereinafter referred to as average velocity data) and its output side is connected to the print start timing generating portion 112. The average velocity data includes average velocity of the conveying belt 28 (average value of conveying velocity determined by measurement or the like in advance), the diameter of the drive roll 24, temperature of the drive roll 24 and the like.

The input side of the print start timing generating portion 112 is connected to the reference clock generating portion 100, average velocity data storage memory 110 and paper detecting sensor 34, and nozzle relationship data such as positional relation of the ink jet recording head 32 and positional relation and distance of the nozzle is inputted thereto. This print start timing generating portion 112 generates a print start timing signal for each nozzle column with the front edge of the paper as a reference position from the nozzle relationship data, reference clock signal from the reference clock generating portion 100, average velocity data from the average velocity data storage memory 110 and a paper detecting signal indicating the front edge of the paper from the paper detecting sensor 34.

The input side of the print signal generating portion 114 is connected to the print clock generating portion 102 and the print start timing generating portion 112 and the output side is connected to the print drive unit 66. This print signal generating portion 114 generates and outputs a print timing signal for each nozzle column of the head from the print clock signal from the print clock generating portion 102 and the print start timing signal from the print start timing generating portion 112.

According to this embodiment, the print timing generating mechanisms 64 include a delay circuit 64A (see FIG. 6) used to delay the print start timing in the print start timing generating portion 112. The delay time of the delay circuit 64A is set as a phase time period for recording the same image at the same position when the paper P is conveyed, or the phase time period for delaying the print start timing of each nozzle column, depending on the installation position of the ink jet recording head 32. This print timing generating mechanism 64 outputs a print clock signal from the print clock generating mechanism 62 after a predetermined time elapses after the paper P is detected, that is, outputs a print clock signal delayed by a delay time of the delay circuit 64A as a print timing signal.

Figure 8:
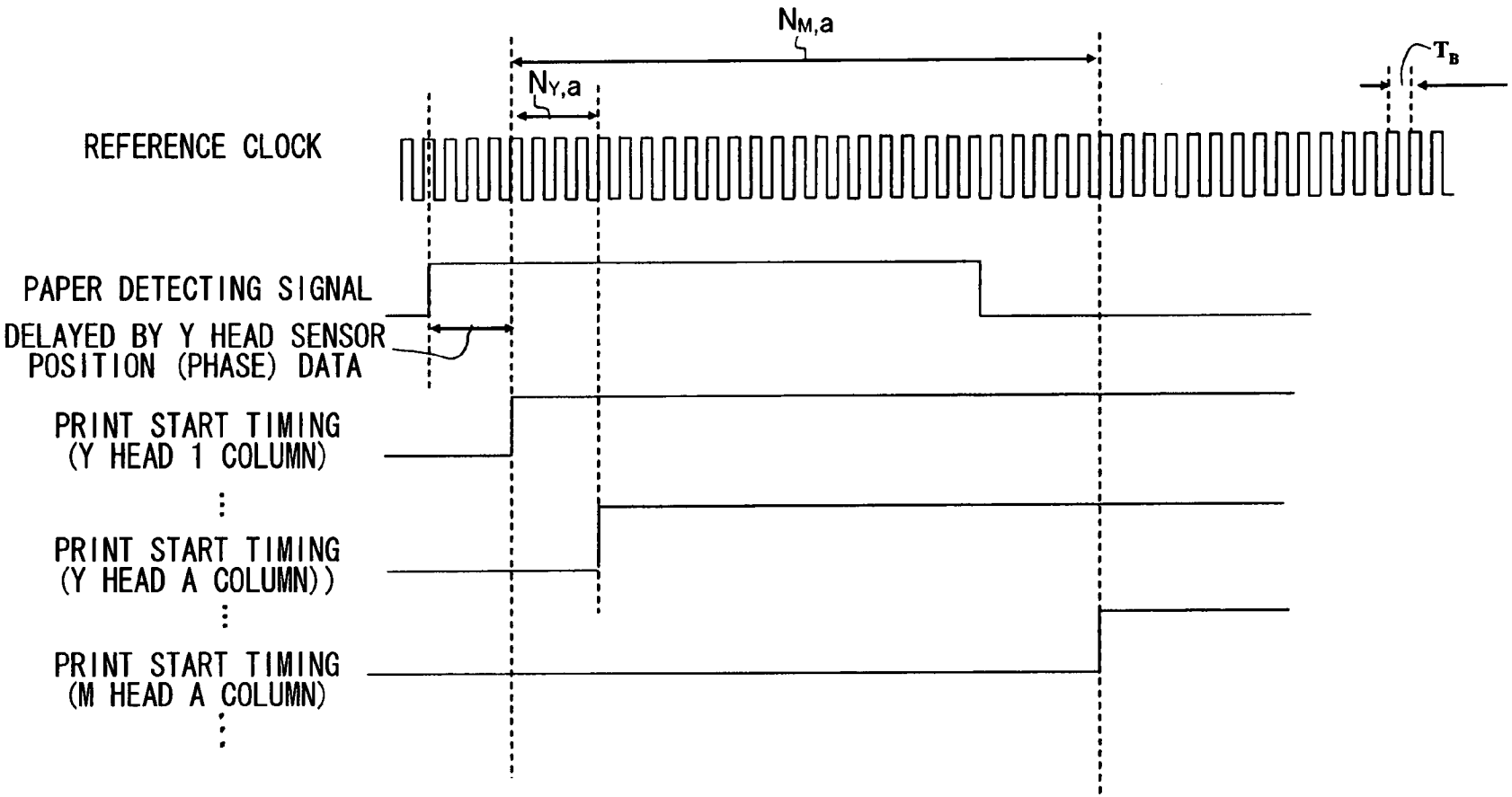
FIG. 8 is a timing chart of a signal relating to generation of print start timing signal in a print start timing generating portion according to the first embodiment of the invention.

FIG. 8 shows a timing chart of a signal relating to generation of the print start timing signal in the print start timing generating portion 112. The print clock generating mechanism 62 generates reference clock signal and print clock signal. Based on the reference clock signal (reference print frequency F) if the front edge of the paper is detected by a paper detecting signal from the paper detecting sensor 34 (leading edge of the paper detection signal based on positive logic in FIG. 8), a timing delayed by a predetermined time, that is, a timing delayed by a time period corresponding to the distance from the front edge of the paper to the ink jet recording head 32 is determined as a print start timing of a first nozzle N (nozzle N at a first column of Y color head in FIG. 8) of the ink jet recording head 32. The print start timing of other nozzles is determined successively with the print start timing of this first nozzle N as the standard. The following equation is a general equation for obtaining this print start timing as a number (count) of pulses of the reference clock.

$$N_{i,a}=\text{round}\left((L(i)+(a-1)ss)/(T_B V_{av})\right)$$

where $N_{i,a}$: reference clock pulse count i: any one of Y, M, C, K (position (color) of recording head)

a: integer (position of nozzle N in recording head 32)

round( ): function for rounding up a numeral to the nearest integer

L(i): distance from a first recording head up to a target recording head

For example, in case of installation at an equal intervals, and integer times the distance between adjoining heads $T_B$: reference clock pulse width (reference clock signal)

$V_{av}$: average velocity ss: nozzle interval

This print start timing signal is outputted to the print signal generating portion 114. The print timing generating mechanism 64 adjusts (synthesizes) a print clock signal generated by the print clock generating portion 102 and outputs as a print timing signal of the ink jet recording head 32 so that printing is started, from the leading edge of the print start timing signal generated in the print start timing generating portion 112.

As shown in FIG. 6, the input side of each of the print drive units 66 for respective colors is connected to the image recording timing control mechanism 60, more specifically, each of the print timing generating mechanisms 64 for the respective colors and image data is inputted thereto. The output side thereof is connected to each of the ink jet recording heads 32. The print drive unit 66 generates a drive signal (a signal which makes each nozzle to eject ink droplet) for recording a predetermined image on the paper P from the print timing signal (image record timing signal), outputted from the image recording timing control mechanism 60, and image data and outputs to the ink jet recording head 32.

Next, the operation of the ink jet recording apparatus 12 which eliminates unevenness in print density generated due to changes in the conveying velocity by a print timing corrected by the average velocity will be described.

In the ink jet recording apparatus 12 of this embodiment, the paper P picked up from the paper feeding tray 16 is conveyed and reaches the conveying belt 28. Then, the paper P is pressed against the conveying belt 28 by the charging roll 35 and suctioned firmly and held by the conveying belt 28 with applied voltage from the charging roll. In this condition, the paper P passes the ink jet area SE by circulation of the conveying belt and ink droplets are ejected from the recording head array 30 so as to record an image on the paper P. The image recording timing is adjusted corresponding to the average velocity at the time of recording the image. If an image is recorded by a single pass, the paper P is separated from the conveying belt 28 by the separating plate 40 and conveyed by the discharge roller pair 42 and discharged to the discharge tray 46. On the other hand, if the image is recorded by multi-pass, the paper P is circulated up to the necessary number of times of passing the ink jet area SE and after that, the paper P is separated from the conveying belt 28 by the separating plate 40 and conveyed by the discharge roller pair 42 and discharged to the discharge tray 46.

Adjustment of the image recording timing corresponding to the average velocity of the paper P is carried out by the image recording timing control mechanism 60 of the recording head controller 78 at the time of recording the image.

The image recording timing control mechanism 60 generates a print clock signal by the print clock generating mechanism 62 and outputs this to the print timing generating mechanism 64. The average velocity data is stored in the average velocity data storage memory 110 of the print timing generating mechanism 64. The print start timing generating portion 112 generates a print start timing signal based on the average velocity data with a paper detecting signal of the paper detecting sensor 34 (front edge of the paper) used as a trigger. Consequently, a print start timing signal generated with the front edge position of the paper P as a starting point can be outputted. A print timing signal is generated from this print start timing signal and print clock and outputted to the ink jet recording head 32 through the print drive unit 66.

As described above, the image recording timing control mechanism 60 included in the ink jet recording apparatus 12 of this embodiment records data on changes in the average velocity of the conveying velocity generated due to differences in the dimension of the drive roll 24 as average velocity data in advance and controls the image recording timing with the front edge position of the paper P as a trigger by using that average velocity data. Consequently, the ink jet recording apparatus 12 which eliminates unevenness in print density generated by changes in the conveying velocity can be provided.

This embodiment succeeds in reducing the size of the apparatus because it can eliminate deviations of image recording timing generated due to changes in the conveying velocity without any restrictions on the interval between the ink jet recording heads 32 of each color.

The paper detecting sensor 34 of this embodiment corresponds to the front edge position detecting unit of the invention. The recording head controller 78 and image recording timing control mechanism 60 of this embodiment correspond to the control unit of the invention. The print clock generating mechanism 62 corresponds to the print clock generating unit of the invention and the print timing generating mechanism 64 corresponds to the print timing generating unit. Further, the average velocity data storage memory 110 corresponds to the memory unit of the invention.

Next, a second exemplary embodiment of the invention will be described. In the first exemplary embodiment, print start timing is corrected in the print start timing generating portion 112 of the print timing generating mechanism 64 in order to eliminate unevenness in print density due to changes in average velocity of the conveying velocity. This embodiment is one in which the print clock itself is adjusted when the print clock serving as the standard of the print timing signal is generated, in order to eliminate unevenness in print density due to changes in the average velocity of the conveying velocity. In the meantime, because this embodiment has substantially the same structure as the above described embodiment, like reference numerals are attached to like components and detailed description thereof is omitted.

Figure 10:
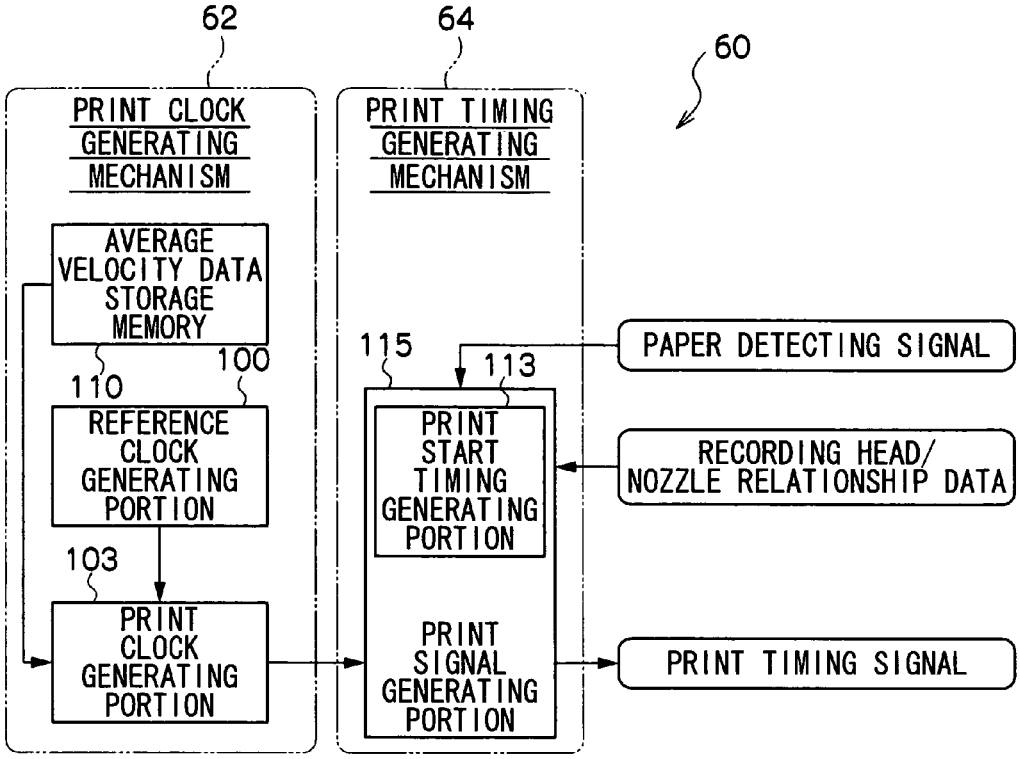
FIG. 10 is a block diagram showing the schematic structure of the image recording timing control mechanism according to a second exemplary embodiment of the invention.

According to this embodiment, as shown in FIG. 10, the print clock generating mechanism 62 is equipped with the average velocity data storage memory 110. This average velocity data storage memory 110 is connected to the print clock generating portion 103. The print clock generating portion 103 has the same structure as the print clock generating portion 102 of FIG. 7 but generates a print clock from the reference clock from the reference clock generating portion 100 and average velocity data. The output side of the print clock generating portion 103 is connected to the input side of the print signal generating portion 115. The print signal generating portion 115 includes a print start timing generating portion 113 having the same structure as the print start timing generating portion 112 of FIG. 7. This print signal generating portion 115 generates a print timing signal for determining a print start timing by means of an included print signal generating portion 115, with a print clock signal from the print clock generating portion 103 inputted to the print signal generating portion 114 of FIG. 7 which generates the print timing signal from the print start timing signal determined based on a reference clock signal in the print start timing generating portion 112. That is, a print timing signal for each nozzle column is generated from print clock signal, nozzle relationship data and paper detection signal (paper detection signal indicating the front edge of paper) of the paper detecting sensor 34.

The print clock generating portion 103 generates the print clock signal (signal of print clock $f_p$) from inputted data according to the following equation:

$$f_P = f_B/(dn+n)$$

where $n = T_{int}/T_B$ $T_P = T_{int} + dn \times T_B$ $dn = \mathrm{round}((T' - T_{int})/T_B)$ $SS = m \times T_{int}$ $V = m \times n \times T_B$ $V = m \times V_{av} T'$ $f_P$: print clock $T_P$: print clock pulse width $f_B$: reference clock $T_B$: reference clock pulse width $f_{int}$: initial print clock (design value)

$T_{int}$: initial print clock pulse width (design value)

f: tentative print clock

T': tentative print clock pulse width $V_{av}$: average value of conveying velocity (average velocity, for example, average belt surface velocity)

V: conveying velocity (design value)

ss: nozzle interval (interval between adjoining nozzles)

n: reference clock pulse count (integer)

m: number of nozzle intervals (integer)

Figure 11:
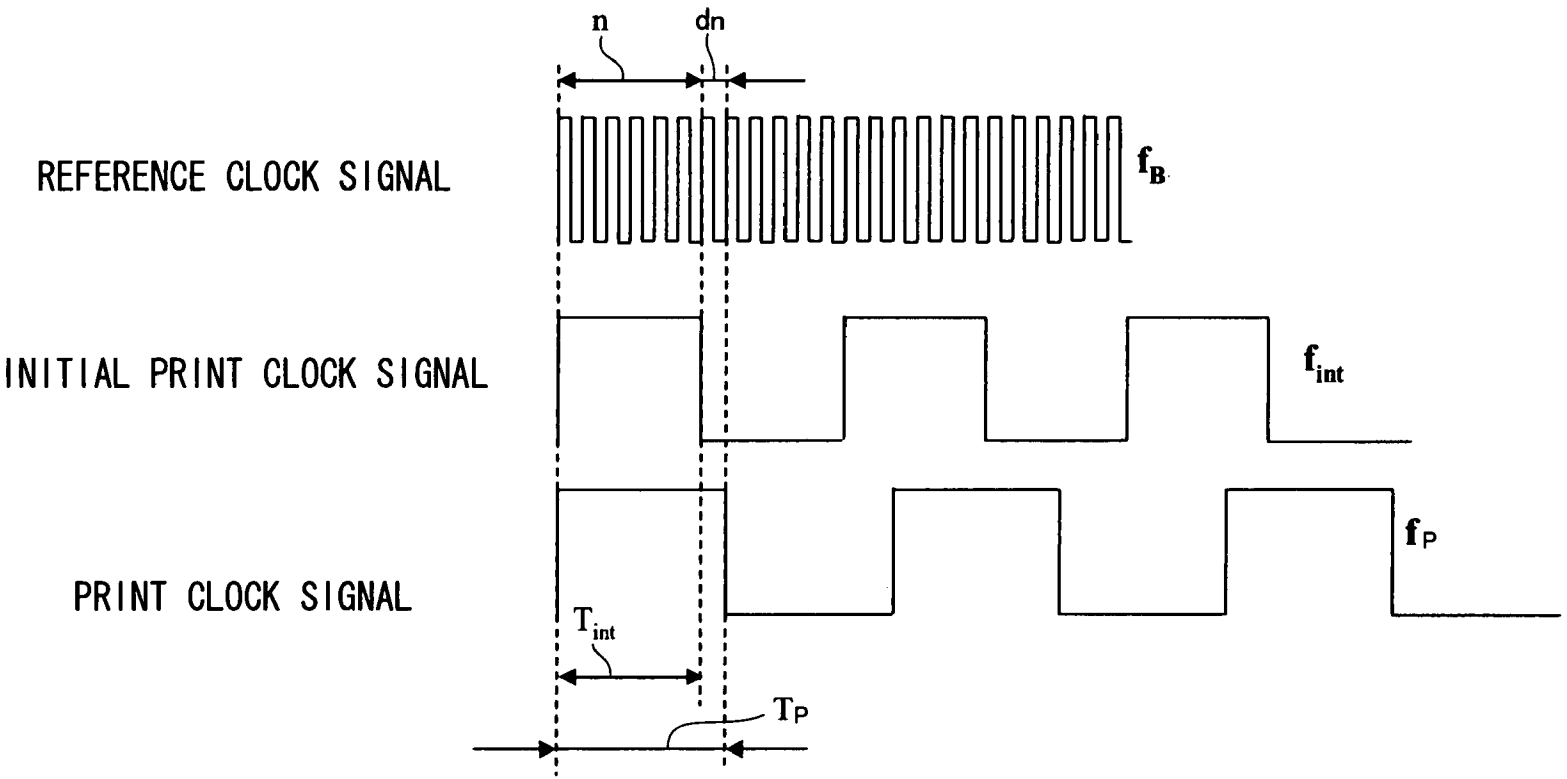
FIG. 11 is a timing chart for explaining the operation of the print clock generating portion according to the second embodiment of the invention.

As shown in FIG. 11, a pulse signal having the pulse width (initial print clock pulse width $T_{int}$) corresponding to n reference clock pulses is generated from the reference clock signal as the initial print clock signal. Next, number of pulses (increment dn) of the reference clock corresponding to a deviation of the print conditions from the design value is obtained to eliminate the deviation of print from the design value, using the average velocity $V_{av}$, conveying velocity, nozzle interval ss and number of nozzle intervals m. Then, a print clock having the pulse width (print clock pulse width $T_P$) is obtained by adjusting the pulse width from the initial print clock signal, that is, adding the increment dn to the reference clock pulse number count n (n+dn) to generate a print clock signal.

A specific calculation example will be described below. If the reference clock $f_B$ is 40 MHz, initial print clock $f_{int}$ is 20 kHz, the average velocity $V_{av}$ is 410 mm/s, the conveying velocity V is 400 mm/s, the nozzle interval ss is 0.5 mm, and the reference clock pulse width $T_B$ is 25 ns, the initial print clock pulse width $T_{int}$ is 50 μs, the number of nozzle intervals m is 25 and the reference clock pulse count n is 2000 and consequently, print clock $f_P$ of 20.502 kHz and print clock pulse width $T_P$ of 48.775 μs are obtained under tentative print clock f of 20.5 kHz, tentative print clock pulse width T' of 48.781 μs and increment dn of 49.

The print clock generating portion 103 outputs the print clock signal generated in the above-described manner to the print signal generating portion 115. This output may be in analog signal or in digital signal like numeral data. The print signal generating portion 115 determines a print start timing with a print clock signal adjusted corresponding to the average velocity, nozzle relationship data and paper detecting signal (paper detecting signal indicating the front edge of the paper) of the paper detecting sensor 34 inputted so as to generate a print timing signal of each nozzle column.

Figure 12:
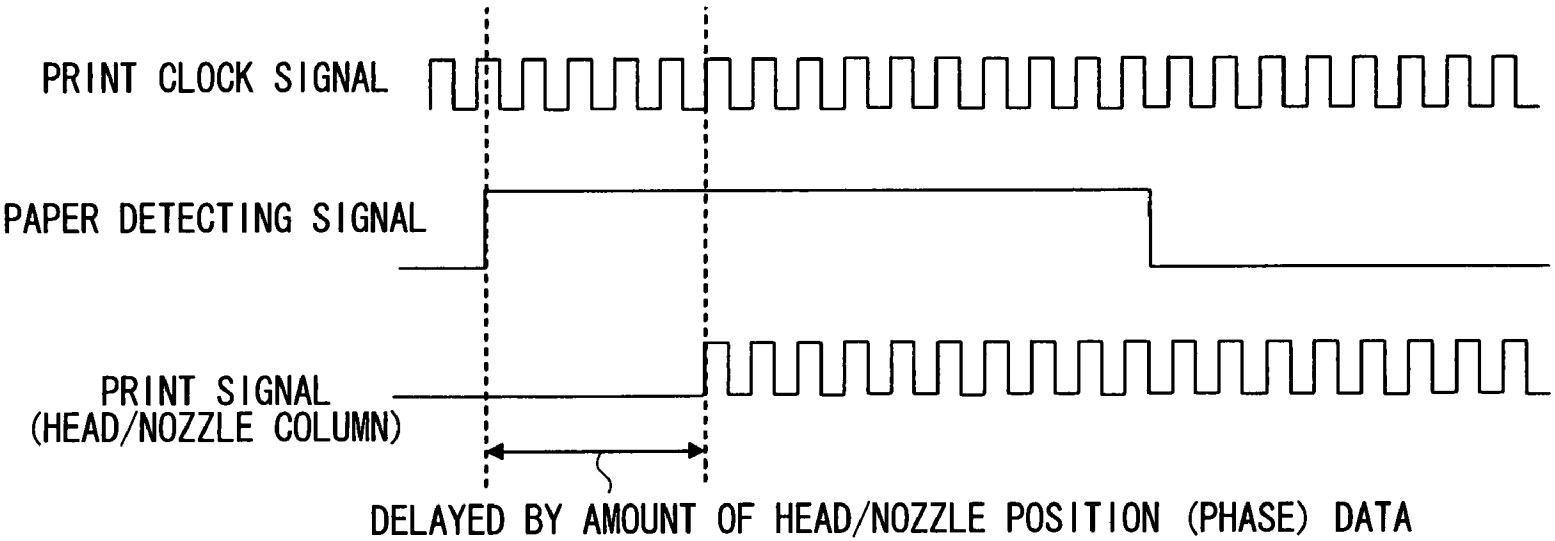
FIG. 12 is a timing chart for explaining the operation of the print signal generating portion according to the second exemplary embodiment of the invention.

FIG. 12 shows a timing chart of signals relating to generation of the print timing signal generated in the print signal generating portion 115. The reference clock signal and print clock signal generated based on the average velocity and the like are inputted to the print clock generating mechanism 62.

The print signal generating portion 115 adopts a timing delayed by a predetermined time from the timing of the paper front edge (leading edge timing of positive logic paper detection signal in FIG. 12), that is, a timing delayed by a time interval corresponding to a distance from the paper front edge to a target nozzle N of the ink jet recording head 32 according to a paper detection signal from the paper detecting sensor 34, as the print start timing of the nozzle N of the ink jet recording head 32 and does not output any print clock signal until the delayed time elapses. Therefore, a print signal which outputs the print clock signal after a delay time elapses from the timing of the paper front edge is outputted to the print drive unit 66 as the print timing signal for the target nozzle N of the ink jet recording head 32.

Using a timing delayed by the predetermined time from the timing (leading edge timing of the positive logic paper detection signal in FIG. 12) of the paper front edge as the print start timing of the nozzle N of the ink jet recording head 32 corresponds to processing of generating the print start timing of the print start timing generating portion 113.

As described above, this embodiment can eliminate unevenness in print density due to changes in average velocity of the conveying velocity because the print clock corresponding to the average velocity of the conveying velocity is adjusted when the print clock which serves as a standard of the print timing signal is generated from the reference clock.

Next, a third exemplary embodiment of the invention will be described. In this embodiment, the invention is applied to the ink jet recording apparatus which generates an image recording timing for eliminating unevenness in print density due to cyclic changes in the conveying velocity. In the meantime, this embodiment can be applied to both the first embodiment and the second embodiment and like reference numerals are attached to like components because this embodiment has substantially the same structure and detailed description thereof is omitted.

Figure 13:
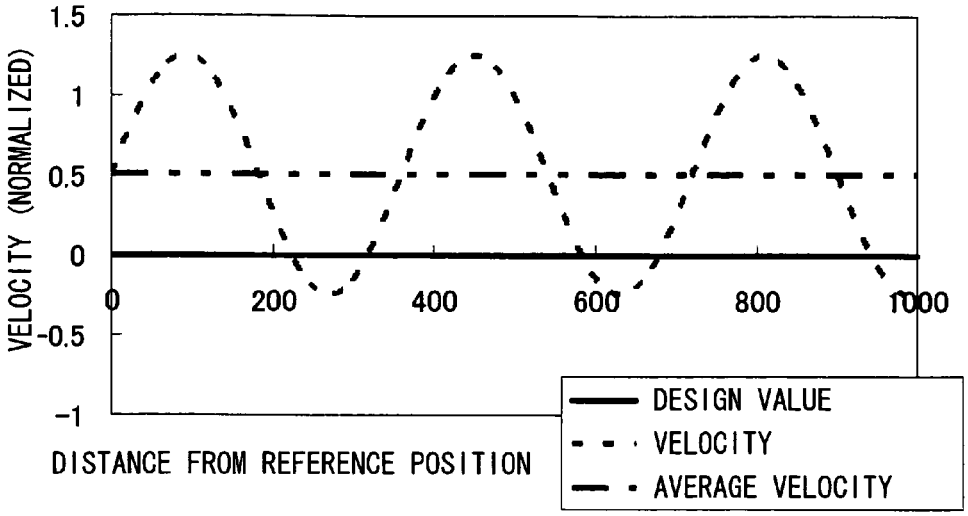
FIG. 13 is a diagram showing the relationship between an ideal value of conveying speed, average speed and cyclic speed change in the ink jet recording apparatus according to a third exemplary embodiment of the invention.

The change in conveying velocity due to unevenness in paper feeding velocity which can be a cause of unevenness in print density may have periodicity because of, for example, eccentricity of the drive roll, gear accuracy, gear backlash, unevenness in thickness of a circulating belt. FIG. 13 shows a variety of characteristics relating to the conveying velocity of the conveying belt 28 by the drive roll. The ordinate axis indicates normalization of the conveying velocity and the abscissa axis indicates a distance of the drive roll 24 from the reference position. The solid line in the Figure indicates an ideal characteristic of the conveying velocity determined from the design values of each component of the ink jet recording apparatus 12 (more specifically, diameter of the drive roll 24, thickness of the conveying belt 28 and the like). The dotted line indicates the characteristics relating to the conveying velocity of the conveying belt 28 by the drive roll. An average value of the characteristics indicated with this dotted line, that is, a characteristic indicated with two dots and a dash line is a characteristic indicating the average velocity of the conveying velocity in the ink jet recording apparatus 12.

As understood from the Figure, if there is cyclic unevenness in conveying velocity, unevenness in print density due to the cyclic change remains even if the print timing signal is adjusted based on the average velocity. That is, even the print timing which instructs formation of linear dots produces dots formed disjointedly in cyclic terms thereby generating unevenness in print density. Thus, this embodiment executes cyclic change of velocity on the print timing as well as adjustment of the print timing based on the average velocity.

The characteristic of the conveying velocity change has a periodicity and although the phase differs depending on which one of the ink jet recording head 32 is being referred to, the curve shapes of the characteristics meet. Thus, the conveying velocity change can be corrected by correcting a single cyclic portion of the characteristic serving as a standard and it can be corrected continuously only by adjusting the phase at a position of each ink jet recording head 32 (adjustment of print start timing).

Next, the detail of the electric recording head controller 78 in the ink jet recording apparatus 12 of this embodiment which eliminates unevenness in print density generated due to cyclic changes in conveying velocity will be described with reference to the drawings.

Figure 14:
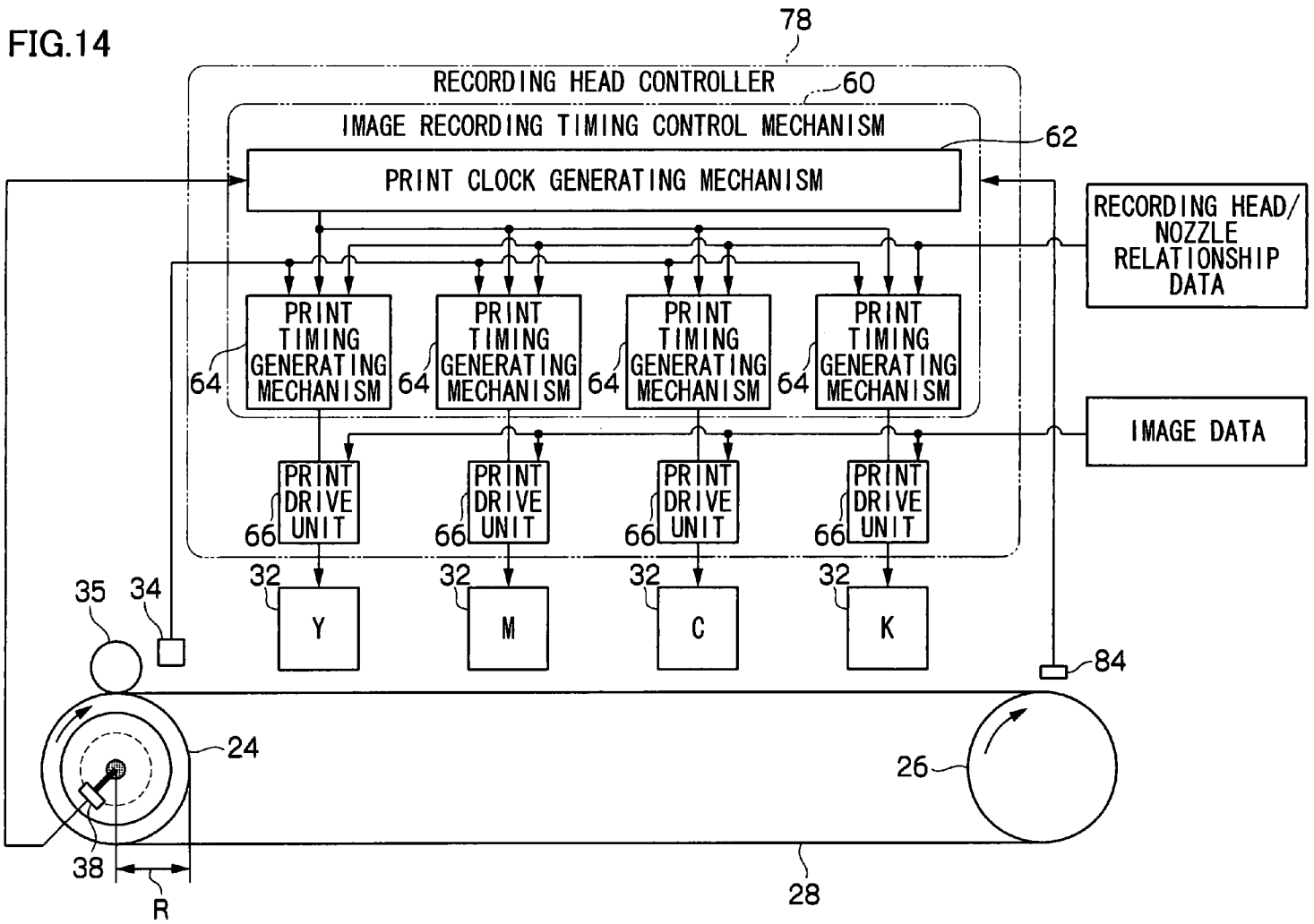
FIG. 14 is a block diagram showing the structure of major portions surrounding an electric recording head controller of the ink jet recording apparatus according to the third exemplary embodiment of the invention.

As shown in FIG. 14, the ink jet recording apparatus 12 of this embodiment includes a reference position detecting sensor 38 for detecting the reference position of the drive roll 24. This reference position detecting sensor 38 is connected to the recording head controller 78 (image recording timing control mechanism 60, print clock generating mechanism 62).

Figure 15:
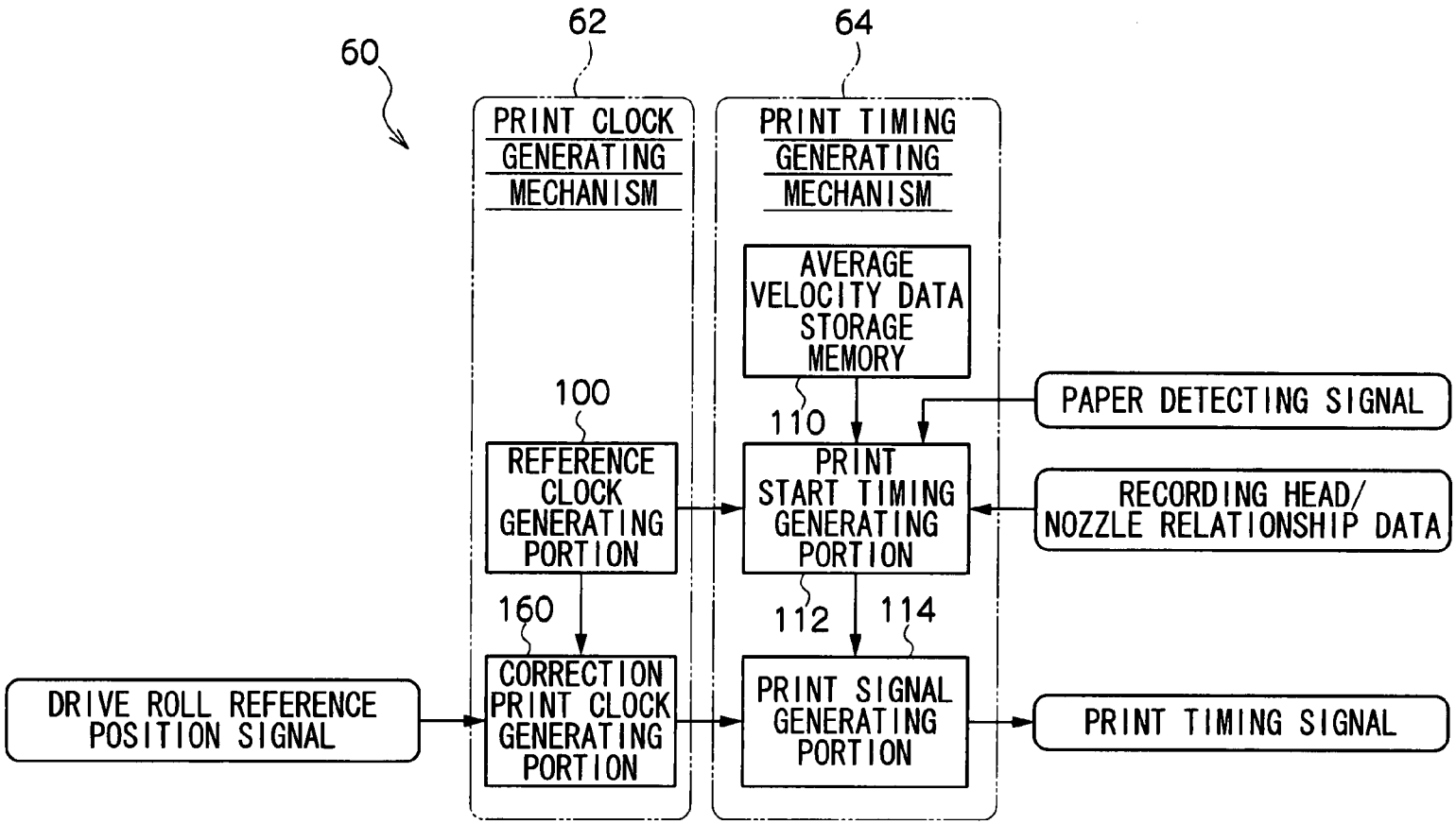
FIG. 15 is a block diagram showing the schematic structure of the image recording timing control mechanism according to the third exemplary embodiment of the invention.

As shown in FIG. 15, the print clock generating mechanism 62 of the image recording timing control mechanism 60 of this embodiment includes a correction print clock generating portion 160 instead of the print clock generating portions 102, 103 and the reference position detecting sensor 38 is connected to this correction print clock generating portion 160. The correction print clock generating portion 160 starts generating the print clock, using a reference position signal of the drive roll 24 from the reference position detecting sensor 38, and based on the reference clock signal from the reference clock generating portion 100.

Figure 16:
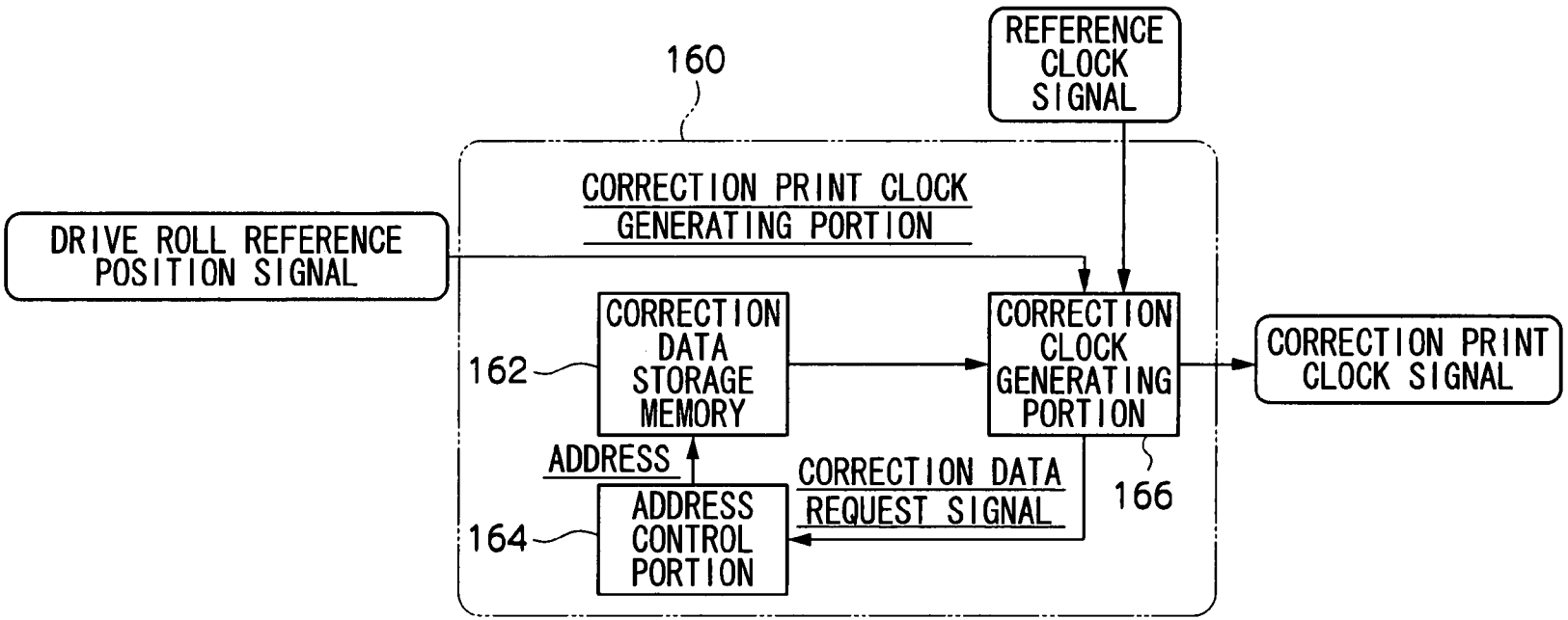
FIG. 16 is a block diagram showing the schematic structure of a correction print clock generating portion according to the third exemplary embodiment of the invention.

As shown in FIG. 16, the correction print clock generating portion 160 includes a correction data storage memory 162, correction clock generating portion 166 and address control portion 164. The correction data storage memory 162 stores correction data of the amount for a single cyclic (amount corresponding to a single rotation of the drive roll 24) with the drive roll reference position as a starting point. This correction data is an amount of correction of the pulse width when the print clock is generated from the reference clock. As the correction data, data obtained by measuring in advance a factor corresponding to a rotation position of the drive roll may be stored or data measured when the power of the apparatus is turned on may be stored.

An example of generation of the correction data may be obtained by measuring a test print. A gray pattern or ladder pattern is printed using only a single nozzle for each color of the ink jet recording heads 32 so as to create a test chart. When there exists a change in conveying velocity, the printed gray pattern or ladder pattern appears with cyclic contrasts in density in the conveying direction. Thus, such cyclic density distribution can be met by measuring the density distribution in the conveying direction.

The correction data storage memory 162 stores addresses successively from correction data corresponding to the positions corresponding to the drive roll reference. That is, addresses correspond to a rotation position of the drive roll 24. The address control portion 164 generates an address for accessing the correction data storage memory 162. The address control portion 164 generates and outputs an address for outputting correction data successively from first address with correction data request signal outputted from the correction clock generating portion 166 adopted as a trigger signal. The correction clock generating portion 104 outputs a correction data request signal with the drive roll reference position signal adopted as a trigger signal and generates a correction print clock signal based on correction data from the correction data storage memory 162.

The correction clock generating portion 166 having the above-described structure outputs a correction data request signal to the address control portion 164 according to the drive roll reference position signal from the reference position detecting sensor 38. In receipt of this correction data is outputted from the correction data storage memory 162. The correction clock generating portion 166 generates and outputs the correction print clock signal. This correction print clock signal adjusts the print clock to eliminate cyclic changes in conveying velocity.

The image recording timing control mechanism 60 included in the ink jet recording apparatus 12 of this embodiment a conveying velocity change having a periodicity generated due to eccentricity of the drive roll 24 or the like is recorded in advance as correction data and controls the image recording timing from the drive roll reference position using the correction data. Consequently, the ink jet recording apparatus 12 can be provided, which eliminates unevenness in print density generated due to both a change in average velocity because of dimensional errors of the drive roll 24 and cyclic conveying velocity changes due to eccentricity of the drive roll 24 because of installation errors.

Although a case where the drive roll reference position is detected with the reference position detecting sensor 38 has been described above, a detector such as an encoder can be attached to the drive roll 24, to detect a drive roll reference position from detected values therefrom.

Meanwhile, the reference position detecting sensor 38 of this embodiment corresponds to an example of the reference position detecting unit of the invention. The correction data storage memory 162 corresponds to the correction data memory unit.

Next, a fourth exemplary embodiment of the invention will be described. In the foregoing exemplary embodiments, the average velocity data is stored in the average velocity data storage memory 110 in order to eliminate unevenness in print density due to changes in average velocity of the conveying velocity, while in this embodiment an input value provided by an input device such as keyboard is used as the average velocity data. As will be appreciated, this embodiment can be applied to any of the above-described respective embodiments and because it has substantially the same structure as the respective embodiments, like reference numerals are attached to like components and detailed description thereof is omitted.

Figure 17:
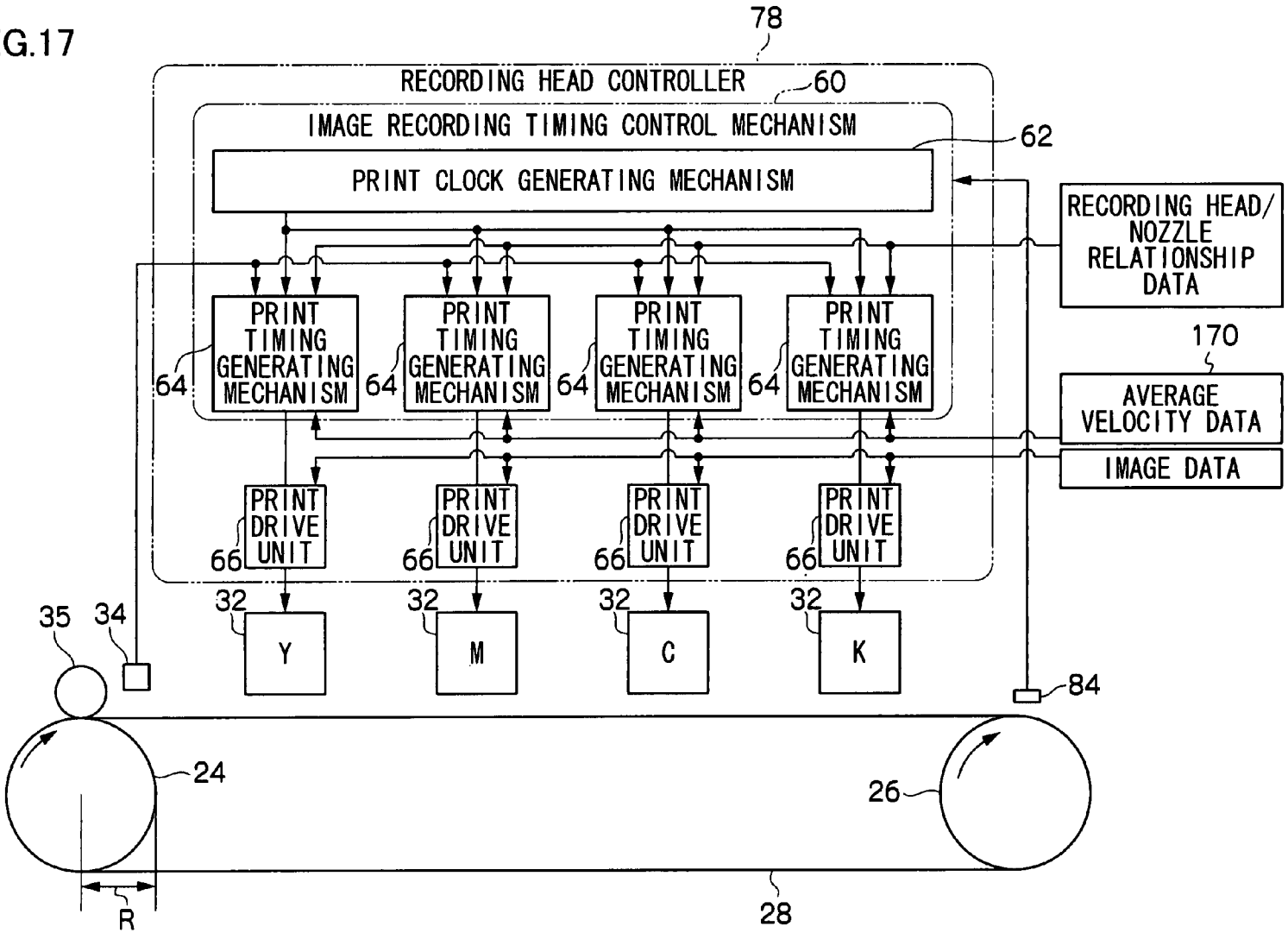
FIG. 17 is a block diagram showing the structure of major portions surrounding an electric recording head controller of the ink jet recording apparatus according to a fourth exemplary embodiment of the invention.
Figure 18:
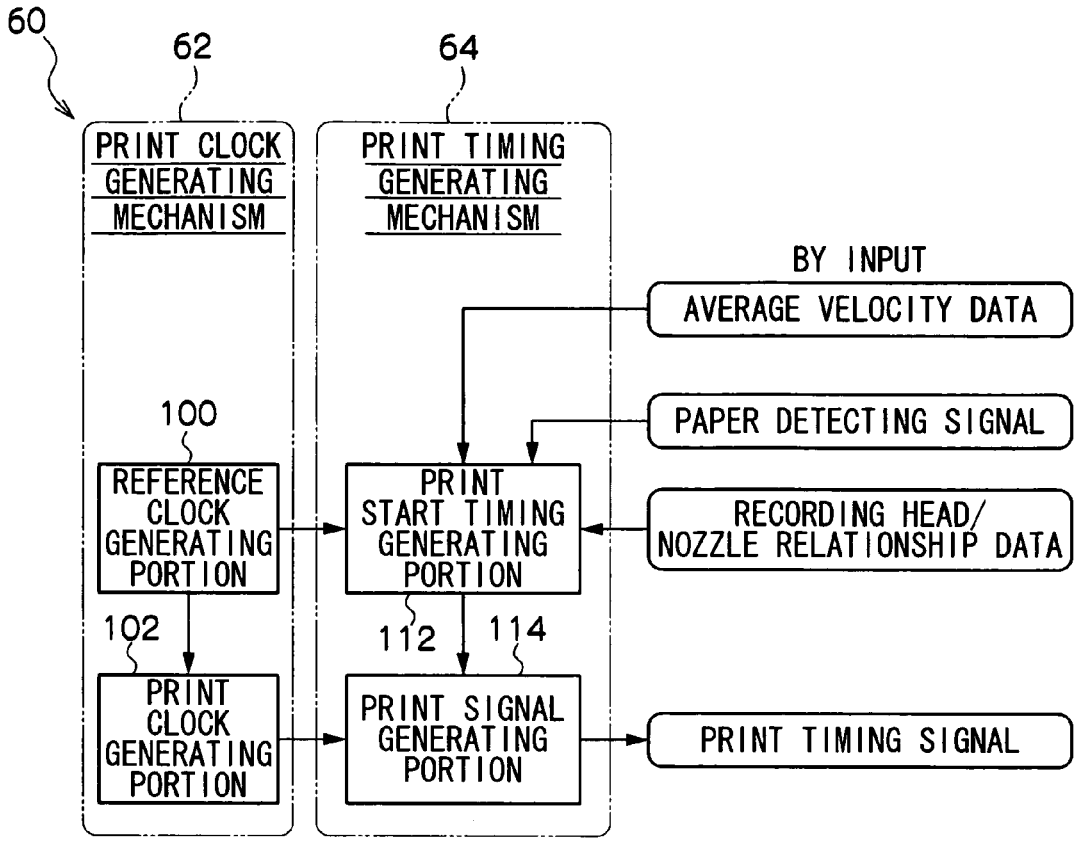
FIG. 18 is a block diagram showing the schematic structure of the image recording timing control mechanism according to the fourth exemplary embodiment of the invention.

As shown in FIG. 17, the ink jet recording apparatus 12 of this embodiment includes an input device 170 such as keyboard for use in inputting the average velocity data. The image recording timing control mechanism 60 of this embodiment does not require the average velocity data storage memory 110, as shown in FIG. 18, and average velocity data inputted through the input device 170 is inputted to the print start timing generating portion 112. In the meantime, the inputted average velocity data may be stored in a memory to hold it temporarily. The data to be inputted is not restricted to the average velocity data but may be data of characteristic of factors contributing to the average velocity, such as finished dimensional data of the drive roll or the like.

As described above, this embodiment provides a structure which allows the average velocity data to be inputted from the input device 170 and thus, is capable of handling changes in average velocity due to replacement of components easily.

Next, a fifth exemplary embodiment of the invention will be described. This embodiment is a modification of the fourth embodiment. Because this embodiment has substantially the same structure as the above-described respective embodiments, like reference numerals are attached to like components and detailed description thereof is omitted.

Figure 19:
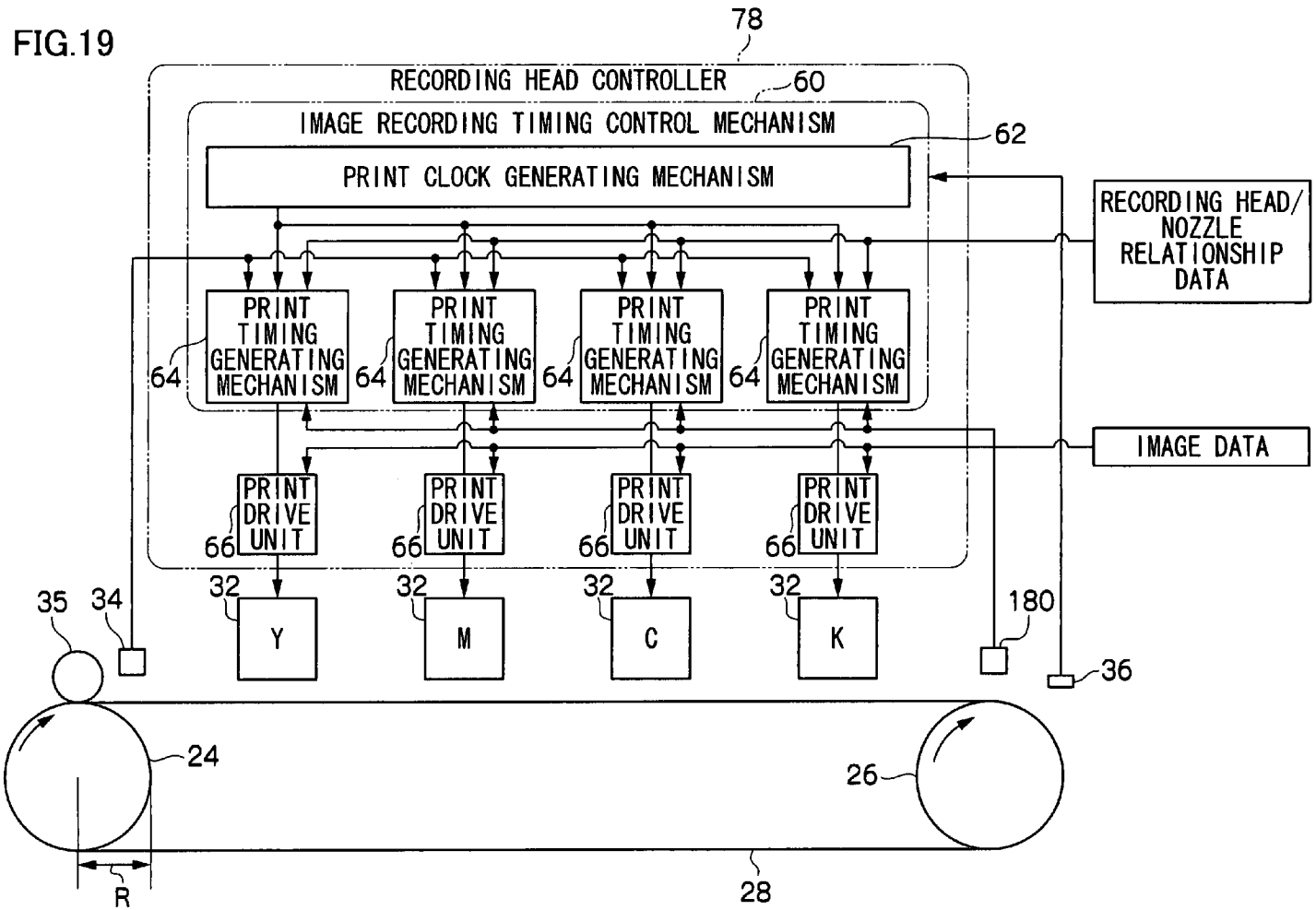
FIG. 19 is a block diagram showing the structure of major portions in the surrounding of the electric recording head controller of the ink jet recording apparatus according to a fifth exemplary embodiment of the invention.
Figure 20:
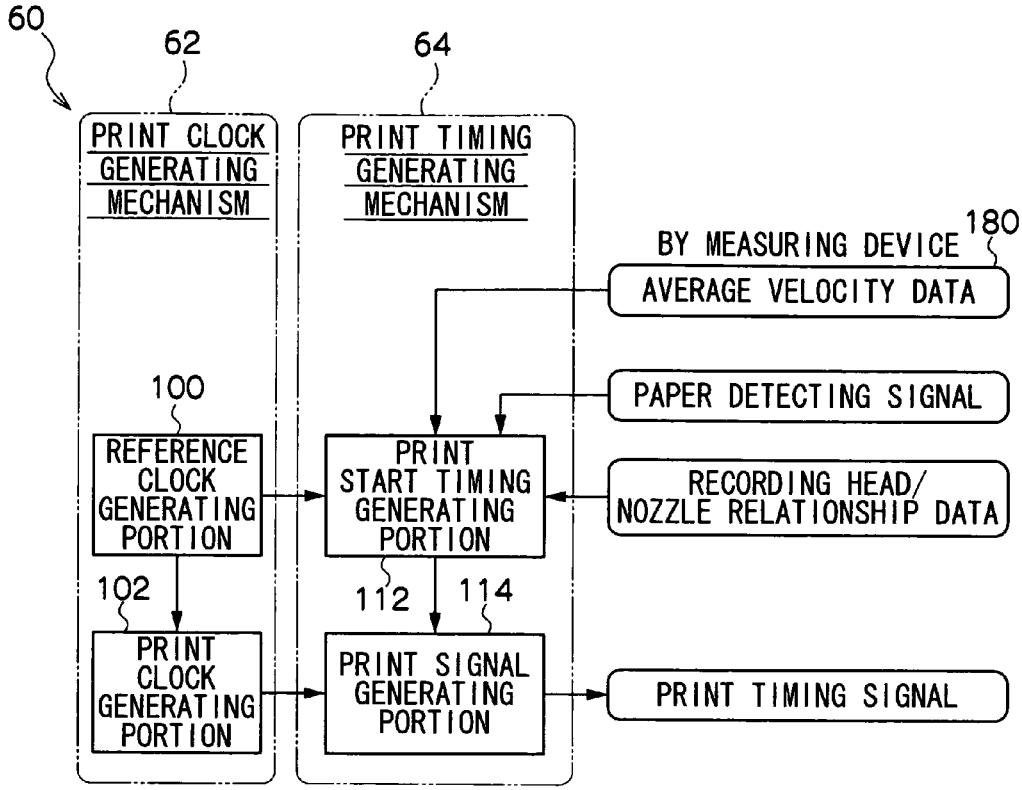
FIG. 20 is a block diagram showing the schematic structure of the image recording timing control mechanism according to the fifth exemplary embodiment of the invention.

As shown in FIG. 19, the ink jet recording apparatus 12 of this embodiment includes a measuring device 180 for measuring the average velocity data. The image recording timing control mechanism 60 of this embodiment does not require the average velocity data storage memory 110, as shown in FIG. 20, and the average velocity data inputted through the input device 170 is inputted to the print start timing generating portion 112. In the meantime, the inputted average velocity data may be stored in a memory so that it is held therein temporarily.

The measuring device 180 measures the average velocity, for example, the average velocity of belt surface, and outputs average velocity data to the recording head controller 78. As an example of the measuring device 180, a laser Doppler velocity meter is available. If the laser Doppler velocity meter has an average velocity computing function, a computed value may be outputted as it is. A computing unit may be provided, which averages the velocity values by the measuring device in a predetermined time (for example, an amount corresponding to a rotation of the drive roll 24) and output these values.

A rotation sensor such a velocity detecting roll may be placed in contact with the drive roll 24 or the driven roll 26 and obtain average velocities from a rotation amount of a velocity detecting roll (rotation sensor) per rotation of the drive roll 24 and the measurement time period (the time for a single rotation of the drive roll 24). Further, mark may be applied onto the conveying belt 28 and the mark measured with the measuring device 180 (for example, detecting it with the line sensor 84). As a simple measuring device 180 in this case, it is permissible to provide plural sensors capable of detecting the mark on the belt on the ink jet recording apparatus 12 (preferably, the distance between the sensors is a length of the periphery of the drive roll) and compute the average velocity from a time taken for the mark on the conveying belt 28 to pass between and a distance between the sensors.

Further, measurements may be undertaken by printing a sample on the paper P. In this case, an average velocity detecting sample (mark) is printed on the paper P (or belt) and detected with the same sorts of sensor.

Because this embodiment is structured such that the average velocity data can be inputted by means of the measuring device 180, it can easily accommodate to changes in average velocity which change in real time.

Next, a sixth exemplary embodiment of the invention will be described. This embodiment adjusts print timing considering changes in average velocity due to a temperature change. This embodiment can be applied to any of the above-described embodiments and has a structure similar to those of the above-described embodiments. Thus, like components are indicated by like reference numerals, and detailed description thereof is omitted.

Figure 21:
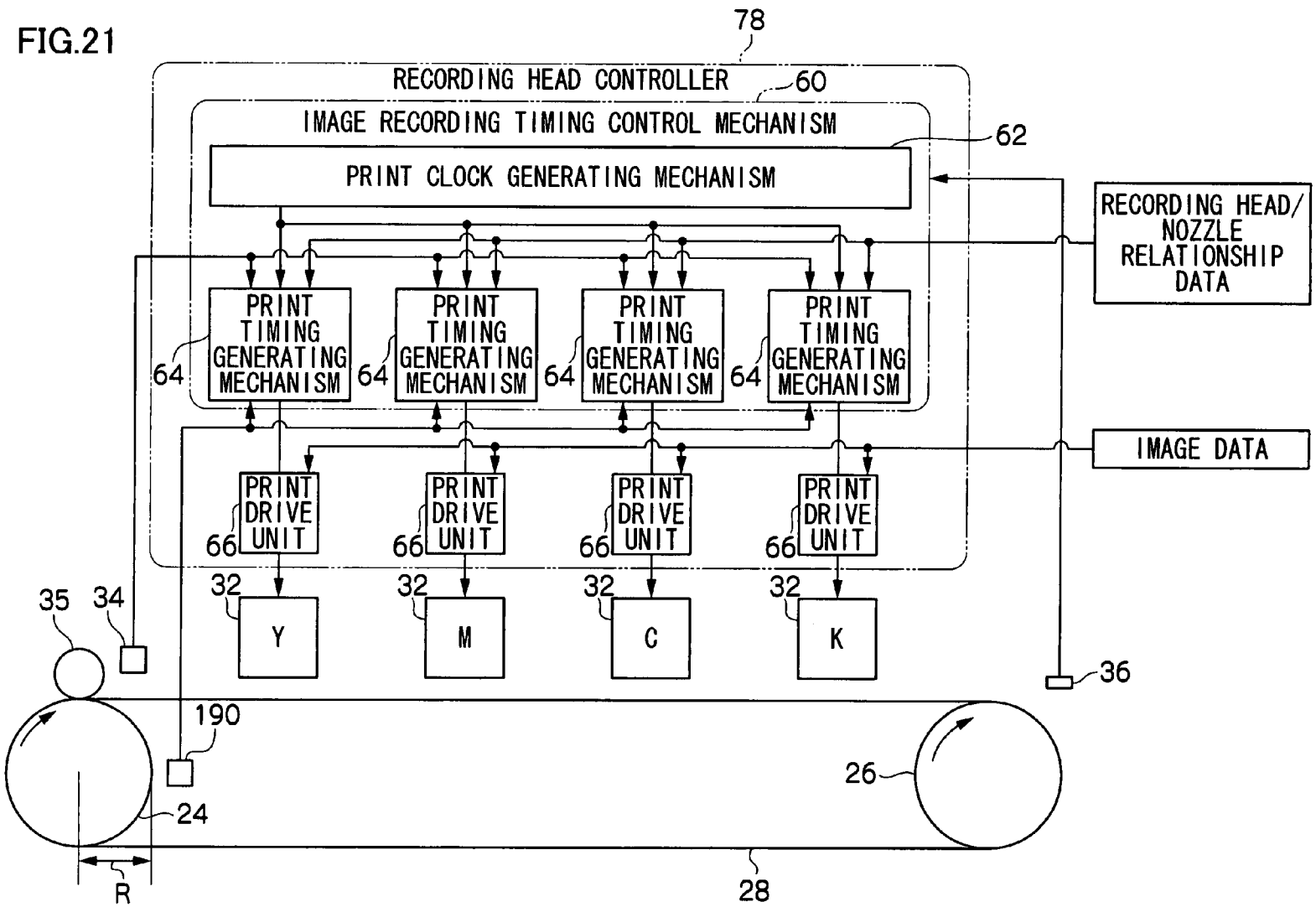
FIG. 21 is a block diagram showing the structure of major portions surrounding an electric recording head controller of the ink jet recording apparatus according to a sixth exemplary embodiment of the invention.
Figure 22:
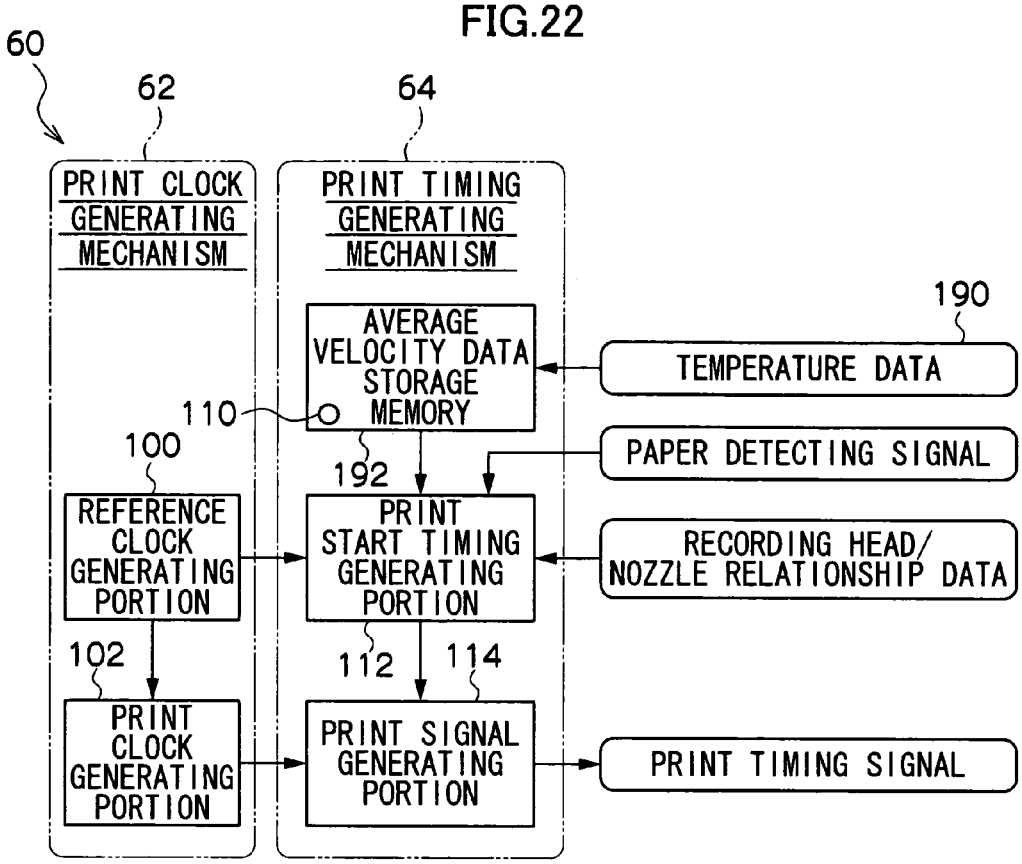
FIG. 22 is a block diagram showing the schematic structure of the image recording timing control mechanism according to the sixth exemplary embodiment of the invention.

As shown in FIG. 21, the ink jet recording apparatus 12 of this embodiment has a temperature sensor 190. The temperature sensor 190 is provided in the vicinity of the drive roll 24 so as to detect the temperature in the vicinity of the drive roll 24. As an examples of the temperature sensor 190, a thermocouple, resistance thermometer or the like are available. This temperature sensor 190 outputs a resistance value, current value and the like as temperature data to the recording head controller 78 (print timing generating mechanism 64 of the image recording timing control mechanism 60 included therein). As shown in FIG. 22, the image recording timing control mechanism 60 of this embodiment includes an average velocity data storage memory 192 having the average velocity data storage memory 110 instead of the average velocity data storage memory 110. Average velocity data generated by this average velocity data generating portion 192 is inputted to the print start timing generating portion 112.

The average velocity data generating portion 192 estimates a change in drive roll diameter due to a temperature change of the drive roll 24. The average velocity of the conveying velocity (average velocity of the surface of the conveying belt 28 or the drive roll 24) is estimated. Data containing estimated average velocity data is outputted to the print start timing generating portion 112 as average velocity data. The average velocity data storage memory 110 stores in advance a reference value of the drive roll diameter and the coefficient of thermal expansion (temperature characteristic) of the drive roll. For estimating the average velocity data generating portion 192 the diameter of the drive roll, the coefficient of thermal expansion of the drive roll under that temperature is obtained from temperature data by the temperature sensor 190 and the diameter of the drive roll is estimated as a change from a reference value of the drive roll diameter. Then, the average velocity is obtained for the drive roll diameter which is the result of this estimation.

The above-described computation results can be stored in advance, that is, the relationship between the temperature and an average velocity corresponding to the temperature can be measured in advance and the measured relationship can be store in the average velocity data storage memory 110 as a table, so as to be read out as an average velocity corresponding to temperature data from the temperature sensor 190.

Because this embodiment is structured so as to be able to change the average velocity corresponding to a temperature change, it can easily handle changes in average velocity corresponding to temperature change in the apparatus.

Meanwhile, the temperature sensor of this embodiment corresponds to an example of the temperature detecting unit of the invention and a processing of estimating the average velocity in the average velocity data generating portion 192 corresponds to part of the function of the control unit.

The present invention has been described about the respective embodiments and the technical scope of the invention is not restricted to the scope described in the specification. The invention can be modified or improved in various ways within a range not departing from the spirit of the invention and such a modified or improved embodiment is also included in the technical scope of the invention.

The above-described respective embodiments do not restrict the invention described in the claims and all combinations described in the embodiments are not always necessary as solutions of the invention. The above-described embodiments include various aspects of the invention and a variety of aspects can be extracted depending on an appropriate combination of the disclosed plural components. Even if some components are removed from the whole of the components indicated in the embodiments, such a composition without some components can be extracted as another aspect of the invention as long as its effect can be obtained.

For example, although a case where storage of correction data into the correction data storage memory 102 included in the print clock generating mechanism 62 is carried out prior to shipment of the ink jet recording apparatus 12 from the factory has been described in the above respective embodiments, the invention is not restricted to this example, but this may be automatically carried out every predetermined period or may be carried out at an arbitrary timing when a user gives an instruction for execution or may be executed at another timing. In these cases, the same effect as the above respective embodiments can be exerted.

The compositions of the ink jet recording apparatus 12, ink jet recording head 32 and recording head controller 78 are example and needless to say, these may be changed appropriately within a range not departing from the spirit of the invention.

Although in the respective embodiments, a case of using ink as droplets for the invention has been described, the invention is not restricted to this example, but for example, reaction liquid may be used instead of ink. In particular, because image quality can be improved by mixing ink droplets with reaction liquid droplets on a recording medium, the invention can be applied in the same manner as described above when reaction liquid is ejected with a nozzle. Additionally, the invention can be applied to coating oriented film formation material for liquid crystal display devices, coating of flux, coating of adhesive agents, coating of wiring material of printed board and the like in the same way as described above.

What is claimed is:

1. An image recording apparatus comprising:

a recording head having recording unit groups each recording unit group including a plurality of recording units for recording an image are linearly arranged at a predetermined interval and at a predetermined angle with respect to a predetermined direction;

a conveying unit for conveying a recording medium to the recording head in the predetermined direction; and a control unit for controlling an image recording start timing of each recording column, with recording units of the plurality of recording units contained in a direction intersecting the predetermined direction of the recording head being recording columns, so as to form a linear dot string on the recording medium having an angle different from the predetermined angle by means of the respective recording units of the recording head when the recording medium is conveyed at a predetermined average velocity.

2. The image recording apparatus according to claim 1 wherein the control unit includes a print clock generating unit for generating a print clock of the recording head from a predetermined reference clock, and the print clock generating unit controls the image recording start timing for each recording column of the recording head.

3. The image recording apparatus according to claim 2 further comprising:

a reference position detecting unit for detecting a reference position when conveying a recording medium by means of the conveying unit; and a correction data memory unit which, when the conveying velocity of the conveying unit changes periodically, for changes in the period from when the reference position is detected to the image recording starting timing stores correction data indicating the relationship between the amount of change from a predetermined value in the change range of the conveying velocity and the amount of correction of the print clock corresponding to the amount of change, the print clock generating unit generating, after the reference position is detected, the print clock of the recording head from the predetermined reference clock so as to record an image at a substantially constant conveying velocity based on the correction data.

4. The image recording apparatus according to claim 3 wherein the control unit includes a memory unit for storing an average velocity for conveying the recording medium and uses the average velocity stored in the memory unit as the predetermined average velocity.

5. The image recording apparatus according to claim 4 wherein the temperature detecting unit is installed in the vicinity of the conveying unit.

6. The image recording apparatus according to claim 2 wherein the control unit includes a memory unit for storing an average velocity for conveying the recording medium and uses the average velocity stored in the memory unit as the predetermined average velocity.

7. The image recording apparatus according to claim 2 further comprising an input unit for inputting an average velocity for conveying the recording medium and the control unit uses the average velocity inputted by the input unit as the predetermined average velocity.

8. The image recording apparatus according to claim 2 wherein the control unit sets the image recording start timing based on an arrangement position from a predetermined position of each of the plural recording heads.

9. The image recording apparatus according to claim 1 wherein the control unit includes a print timing generating unit for generating an image recording timing signal of the recording head based on a predetermined print clock and the print timing generating unit controls the image recording start timing for each recording column of the recording head.

10. The image recording apparatus according to claim 9 wherein the control unit includes a memory unit for storing an average velocity for conveying the recording medium and uses the average velocity stored in the memory unit as the predetermined average velocity.

11. The image recording apparatus according to claim 9 further comprising an input unit for inputting an average velocity for conveying the recording medium and the control unit uses the average velocity inputted by the input unit as the predetermined average velocity.

12. The image recording apparatus according to claim 1 wherein the control unit includes a memory unit for storing an average velocity for conveying the recording medium and uses the average velocity stored in the memory unit as the predetermined average velocity.

13. The image recording apparatus according to claim 1 further comprising an input unit for inputting an average velocity for conveying the recording medium and the control unit uses the average velocity inputted by the input unit as the predetermined average velocity.

14. The image recording apparatus according to claim 1 further comprising a velocity detecting unit for detecting an average velocity for conveying the recording medium and the control unit computes the average velocity based on a velocity detected by the velocity detecting unit and uses the computed average velocity as the predetermined average velocity.

15. The image recording apparatus according to claim 1 further comprising a temperature detecting unit for detecting a temperature in the apparatus and the control unit estimates the amount of change of the average velocity based on the temperature detected by the temperature detecting unit and uses the estimated average velocity as the predetermined average velocity.

16. The image recording apparatus according to claim 1 further comprising a front edge position detecting unit for detecting the position of a front edge of a recording medium conveyed by the conveying unit and the control unit, when detecting the front edge position, sets up an image recording start timing of the recording head based on a distance from the front edge position to the installation position of the recording head.

17. The image recording apparatus according to claim 1 wherein the angle different from the predetermined angle is in a direction perpendicular to the predetermined direction.

18. The image recording apparatus according to claim 1 wherein the recording head is a droplet ejecting head in which: as the recording unit there is a unit structure body including a nozzle column comprised of a plurality of nozzles for ejecting droplets for recording an image; as a recording unit group there is a plurality of nozzles disposed linearly at a predetermined interval at a predetermined angle with respect to a predetermined direction; and a plurality of the unit structure bodies are disposed in a direction perpendicular to the predetermined direction.

19. The image recording apparatus according to claim 1 wherein the recording head is a plurality of recording heads provided independently for each of predetermined plural colors.

* * * * *